US005938507A

United States Patent [19]

Ko et al.

[11] Patent Number: 5,938,507

[45] Date of Patent: Aug. 17, 1999

[54] LINEAR CONDITIONER APPARATUS FOR A CHEMICAL MECHANICAL POLISHING SYSTEM

[75] Inventors: Sen-Hou Ko, Cupertino; Richard V. Rafloski, San Jose; James C. Nystrom, Palo Alto; John Prince, Los Altos; Alfred A. Goldspiel, Watsonville; Stephen J. Blumenkranz, Redwood City; Manoocher Birang, Los Gatos, all of Calif.

[73] Assignee: Applied Materials, Inc., Santa Clara, Calif.

[21] Appl. No.: 08/549,480

[22] Filed: Oct. 27, 1995

[51] Int. Cl.[6] ..... B24B 21/18

[52] U.S. Cl. ..... 451/56; 451/41; 451/443; 451/285; 451/287; 451/289

[58] Field of Search ..... 451/56, 443, 444, 451/285–289, 41

[56] References Cited

U.S. PATENT DOCUMENTS

| | | | |
|---|---|---|---|
| 4,959,928 | 10/1990 | Hartwig, Sr. | 51/262 A |
| 5,070,570 | 12/1991 | Sabo | 15/160 |
| 5,081,051 | 1/1992 | Mattingly et al. | 437/10 |
| 5,154,021 | 10/1992 | Bombardier et al. | 51/262 A |
| 5,167,667 | 12/1992 | Prigge et al. | 8/137 |
| 5,216,843 | 6/1993 | Breivogel et al. | 51/131.1 |
| 5,456,627 | 10/1995 | Jackson et al. | 451/11 |
| 5,486,131 | 1/1996 | Cesna et al. | 451/56 |
| 5,690,544 | 11/1997 | Sakurai | 451/444 |

FOREIGN PATENT DOCUMENTS

A-674972 4/1995 European Pat. Off. .

OTHER PUBLICATIONS

Pad Conditioning by Research Disclosure Feb. 1991.

*Primary Examiner*—Robert A. Rose
*Assistant Examiner*—George Nguyen
*Attorney, Agent, or Firm*—Fish & Richardson

[57] ABSTRACT

A conditioner apparatus uses one or more linear conditioners. The linear conditioners extend from the edge of the polishing pad almost to the center of the pad. The conditioner apparatus may use two conditioner rods located on either side of a radial segment. The rods gimbal so that if one rod rises, the other rod is forced downwardly. In addition, the rods can pivot independently about a lateral axis, but they cannot pivot around the vertical axis. The linear conditioners may be actuated by a piezoelectric member or swept by an arm toward and away from the center of the polishing pad.

18 Claims, 18 Drawing Sheets

LINEAR CONDITIONER APPARATUS FOR A CHEMICAL MECHANICAL POLISHING SYSTEM

CROSS REFERENCE TO RELATED APPLICATIONS

This application is related concurrently filed U.S. Application entitled CONTINUOUS PROCESSING SYSTEM FOR CHEMICAL MECHANICAL POLISHING, attorney docket AM881, and assigned to the assignee of the present application. The entire disclosure of that application is hereby incorporated by reference.

BACKGROUND OF THE INVENTION

The invention relates to chemical mechanical polishing of substrates, and more particularly to a linear conditioner for conditioning a polishing pad.

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e., the exposed surface of the substrate, becomes successively more non-planar. This occurs because the distance between the outer surface and the underlying substrate is greatest in regions of the substrate where the least etching has occurred, and least in regions where the greatest etching has occurred. With a single patterned underlying layer, this non-planar surface comprises a series of peaks and valleys wherein the distance between the highest peak and the lowest valley may be the order of 7000 to 10,000 Angstroms. With multiple patterned underlying layers, the height difference between the peaks and valleys becomes even more severe, and can reach several microns.

This non-planar outer surface presents a problem for the integrated circuit manufacturer. If the outer surface is non-planar, then photolithographic techniques to pattern photoresist layers might not be suitable, as a non-planar surface can prevent proper focusing of the photolithography apparatus. Therefore, there is a need to periodically planarize this substrate surface to provide a planar layer surface. Planarization, in effect, polishes away a non-planar, outer surface, whether a conductive, semiconductive, or insulative layer, to form a relatively flat, smooth surface. Following planarization, additional layers may be deposited on the outer layer to form interconnect lines between features, or the outer layer may be etched to form vias to lower features.

Chemical mechanical polishing is one accepted method of planarization. This planarization method typically requires that the substrate be mounted on a carrier or polishing head, with the surface of the substrate to be polished exposed. The substrate is then placed against a rotating polishing pad. In addition, the carrier head may rotate to provide additional motion between the substrate and polishing surface. Further, a polishing slurry, including an abrasive and at least one chemically-reactive agent, may be spread on the polishing pad to provide an abrasive chemical solution at the interface between the pad and substrate.

Important factors in the chemical mechanical polishing process are: the finish (roughness) and flatness (lack of large scale topography) of the substrate surface, and the polishing rate. Inadequate flatness and finish can produce substrate defects. The polishing rate sets the time needed to polish a layer. Thus, it sets the maximum throughput of the polishing apparatus.

Each polishing pad provides a surface which, in combination with the specific slurry mixture, can provide specific polishing characteristics. Thus, for any material being polished, the pad and slurry combination is theoretically capable of providing a specified finish and flatness on the polished surface. The pad and slurry combination can provide this finish and flatness in a specified polishing time. Additional factors, such as the relative speed between the substrate and pad, and the force pressing the substrate against the pad, affect the polishing rate, finish and flatness.

Because inadequate flatness and finish can create defective substrates, the selection of a polishing pad and slurry combination is usually dictated by the required finish and flatness. Given these constraints, the polishing time needed to achieve the required finish and flatness sets the maximum throughput of the polishing apparatus.

An additional limitation on polishing throughput is "glazing" of the polishing pad. Glazing occurs when the polishing pad is heated and compressed in regions where the substrate is pressed against it. The peaks of the polishing pad are pressed down and the pits of the polishing pad are filled up, so the surface of the polishing pad becomes smoother and less abrasive. As a result, the polishing time required to polish a substrate increases. Therefore, the polishing pad surface must be periodically returned to an abrasive condition, or "conditioned", to maintain a high throughput.

An additional consideration in the production of integrated circuits is process and product stability. To achieve a low defect rate, each successive substrate should be polished under similar conditions. Each substrate should be polished by approximately the same amount so that each integrated circuit is substantially identical.

In view of the foregoing, there is a need for a chemical mechanical polishing apparatus which optimizes polishing throughput, flatness, and finish, while minimizing the risk of contamination or destruction of any substrate.

Specifically, there is a need for an apparatus to condition a polishing pad. Such an apparatus should wear the surface of the polishing pad thoroughly and uniformly to remove glazing without creating non-uniformities in the pad. In addition, such an apparatus should be resistant to the chemicals used in the polishing process.

Additional advantages of the invention will be set forth in the description which follows, and in part will be obvious from the description, or may be learned by practice of the invention. The advantages of the invention may be realized by means of the instrumentalities and combinations particularly pointed out in the claims.

SUMMARY OF THE INVENTION

One embodiment of the present invention is a chemical mechanical polishing system comprising a rotating polishing pad and a conditioner member having an abrasive surface. The abrasive surface contacts the polishing pad in a linear segment extends from an edge of the polishing pad to near a center of the polishing pad. In an implementation, the conditioner member may be a rod.

In another embodiment, the conditioner apparatus comprises two conditioner members having abrasive surfaces. The conditioner members contact the polishing pad in two substantially parallel linear segments.

Implementations of the invention include the following. The conditioner apparatus may have a gimbal mechanism connected to said first and second conditioner members. The gimbal mechanism prevents the members from pivoting about the first axis. The gimbal mechanism permits the members to pivot together about a second axis parallel to the longitudinal axis of the conditioner members and located in a plane where the members contact the polishing pad. The gimbal mechanism permits the members to pivot independently about a third axis perpendicular to the first and second axis. The gimbal mechanism may includes a pin which extends along the third axis and passes through passages in the first and second conditioner members. The gimbal mechanism may also include a flexure joint. The conditioner apparatus may have a load mechanism to press said the conditioner members against the polishing pad, and a means, such as an arm or piezoelectric actuator, to radially oscillate the conditioner members.

In another embodiment, the invention is a method of conditioner a polishing pad. The method comprises the step of bringing a member having an abrasive outer surface into contact with the polishing pad along a linear strip which extends from an edge of said polishing pad to near a center of said polishing pad.

Implementation of the invention include the following. A second conditioner member may be pressed against the polishing pad. The conditioner member may be radially oscillated. The conditioner member may oscillate less than a millimeter. The polishing pad may rotate relative to the conditioning member.

BRIEF DESCRIPTION OF THE DRAWINGS

The accompanying drawings, which are incorporated in and constitute a part of the specification, schematically illustrate a preferred embodiment of the invention, and together with the general description given above and the detailed description of the preferred embodiment given below, serve to explain the principles of the invention.

Description of the Preferred Embodiment(s)

Figure 1A:
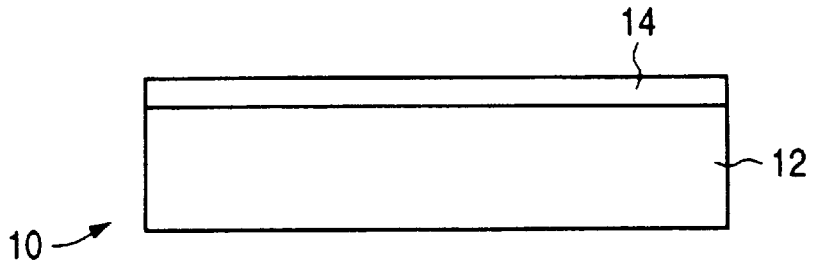
FIGS. 1A–1E are schematic diagrams illustrating the deposition and etching of a layer on a substrate.
Figure 1B:
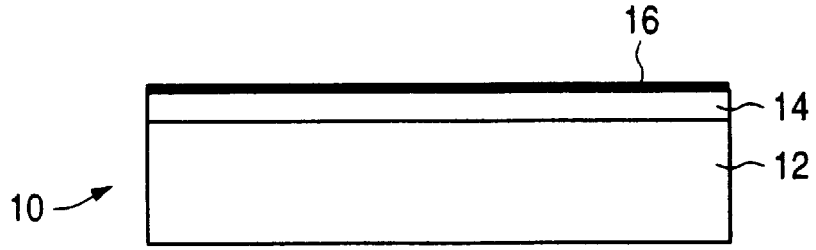
Figure 1C:
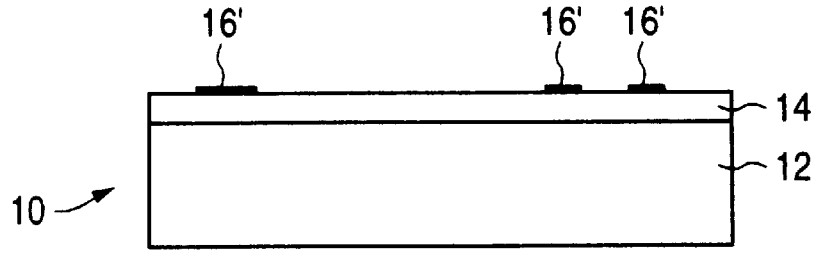
Figure 1D:
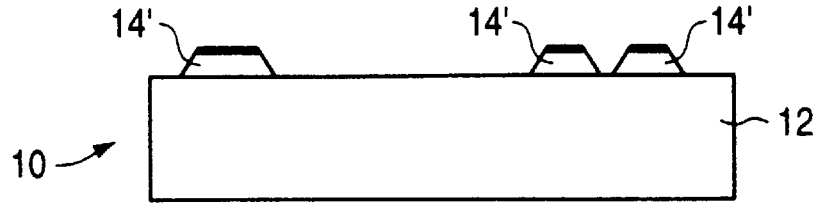
Figure 1E:
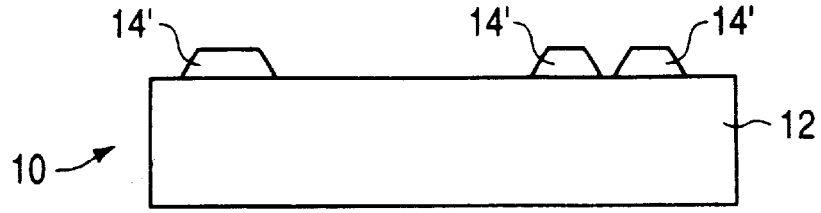

FIGS. 1A–1E illustrate the process of depositing a layer onto a planar surface of a substrate. As shown in FIG. 1A, a substrate 10 might be processed by coating a flat semiconductive silicon wafer 12 with a metal layer 14, such as aluminum. Then, as shown in FIG. 1B, a layer of photoresist 16 may be placed on metal layer 14. Photoresist layer 16 can then be exposed to a light image, as discussed in more detail below, producing a patterned photoresist layer 16' shown in FIG. 1C. As shown in FIG. 1D, after patterned photoresist layer 16' is created, the exposed portions of metal layer 14 are etched to create metal islands 14'. Finally, as shown in FIG. 1E, the remaining photoresist is removed.

Figure 2A:
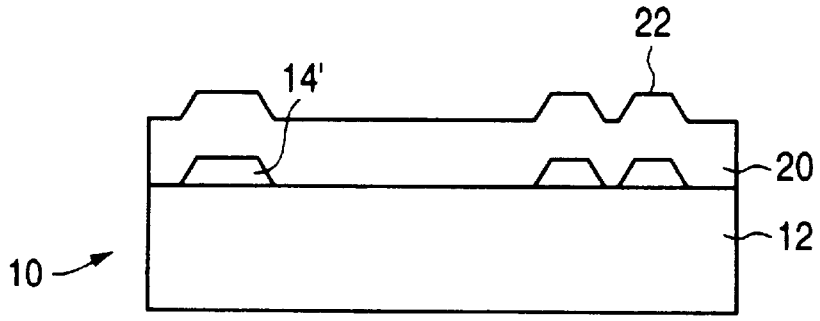
FIGS. 2A–2C are schematic diagrams illustrating the polishing of a non-planar outer surface of a substrate.
Figure 2B:
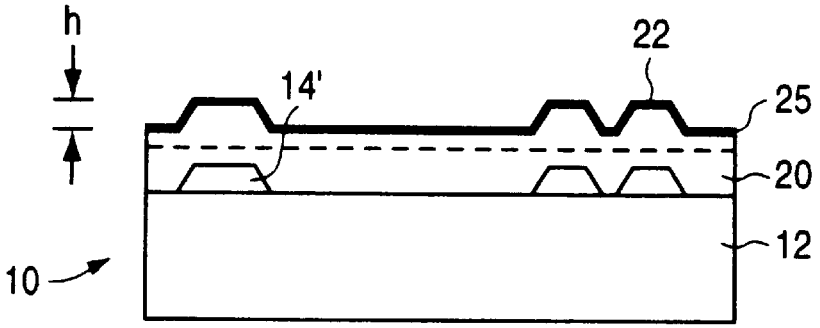

FIGS. 2A–2B illustrate the difficulty presented by deposition of subsequent layers on a substrate. As shown in FIG. 2A, an insulative layer 20, such as silicon dioxide, may be deposited over metal islands 14'. The outer surface 22 of insulative layer 20 almost exactly replicates the underlying structures of the metal islands, creating a series of peaks and valleys so outer surface 22 is non-planar. An even more complicated outer surface would be generated by depositing and etching multiple layers on an underlying patterned layer.

If, as shown in FIG. 2B, outer surface 22 of substrate 10 is non-planar, then a photoresist layer 25 placed thereon is also non-planar. A photoresist layer is typically patterned by a photolithographic apparatus that focuses a light image onto the photoresist. Such an imaging apparatus typically has a depth of focus of about 0.2 to 0.4 microns for sub-halfmicron feature sizes. If the photoresist layer 25 is sufficiently non-planar, that is, if the maximum height difference h between a peak and valley of outer surface 22 is greater than the depth of focus of the imaging apparatus, then it will be impossible to properly focus the light image onto the entire surface 22. Even if the imaging apparatus can accommodate the non-planarity created by a single underlying patterned layer, after the deposition of a sufficient number of patterned layers, the maximum height difference will exceed the depth of focus.

It may be prohibitively expensive to design new photolithographic devices having an improved depth of a focus. In addition, as the feature size used in integrated circuits becomes smaller, shorter wavelengths of light must be used, resulting in further reduction of the available depth of focus.

Figure 2C:
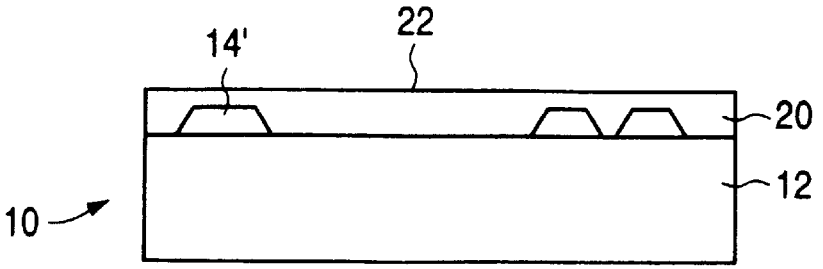

A solution, as shown in FIG. 2C, is to planarize the outer surface. Planarization wears away the outer surface, whether metal, semiconductive, or insulative, to form a substantially smooth, flat outer surface 22. As such, the photolithographic apparatus can be properly focused. Planarization could be performed only when necessary to prevent the peak-tovalley difference from exceeding the depth of focus, or planarization could be performed each time a new layer is deposited over a patterned layer.

Polishing may be performed on metallic, semiconductive, or insulative layers. The particular reactive agents, abrasive particles, and catalysts will differ depending on the surface being polishing. The present invention is applicable to polishing of any of the above layers.

Figure 3:
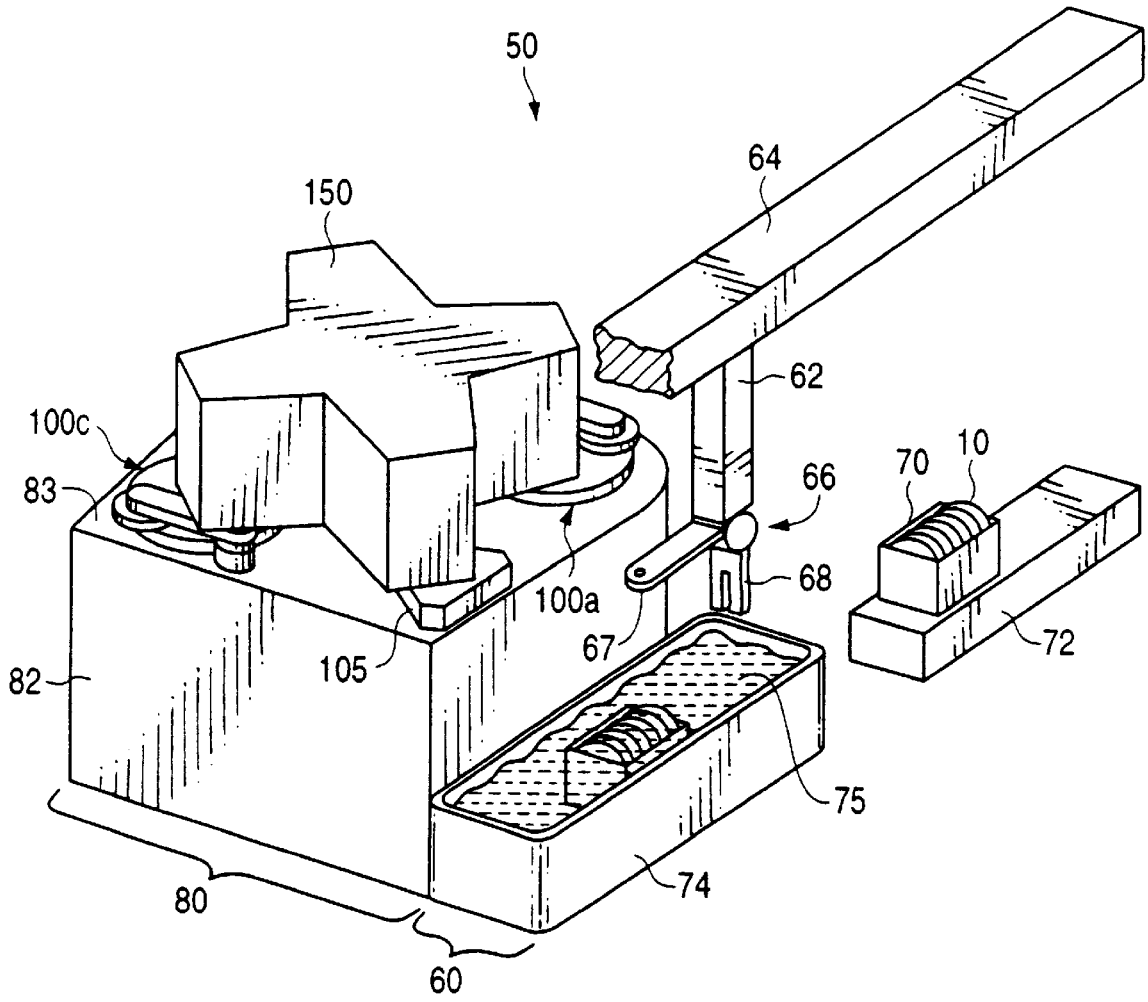
FIG. 3 is a schematic perspective view of a chemical mechanical polishing apparatus.

As shown in FIG. 3, a chemical mechanical polishing system 50 according to the present invention includes a loading apparatus 60 adjacent to a polishing apparatus 80. Loading apparatus 60 includes a rotatable, extendable arm 62 hanging from an overhead track 64. In the figure, overhead track 64 has been partially cut-away to more clearly show polishing apparatus 80. Arm 62 ends in a wrist assembly 66 which includes a blade 67 with a vacuum port and a cassette claw 68.

Substrates 10 are brought to polishing system 50 in a cassette 70 and placed on a holding station 72 or directly into a tub 74. Cassette claw 68 on arm 64 may be used to grasp cassette 70 and move it from holding station 72 to tub 74. Tub 74 is filled with a liquid bath 75, such as deionized water. Blade 67 fastens to an individual substrate from cassette 70 in tub 74 by vacuum suction, removes the substrate from cassette 70, and loads the substrate into polishing apparatus 80. Once polishing apparatus 80 has completed polishing the substrate, blade 67 returns the substrate to the same cassette 70 or to a different one. Once all of the substrates in cassette 70 are polished, claw 68 may remove cassette 70 from tub 74 and return the cassette to holding station 72.

Figure 4:
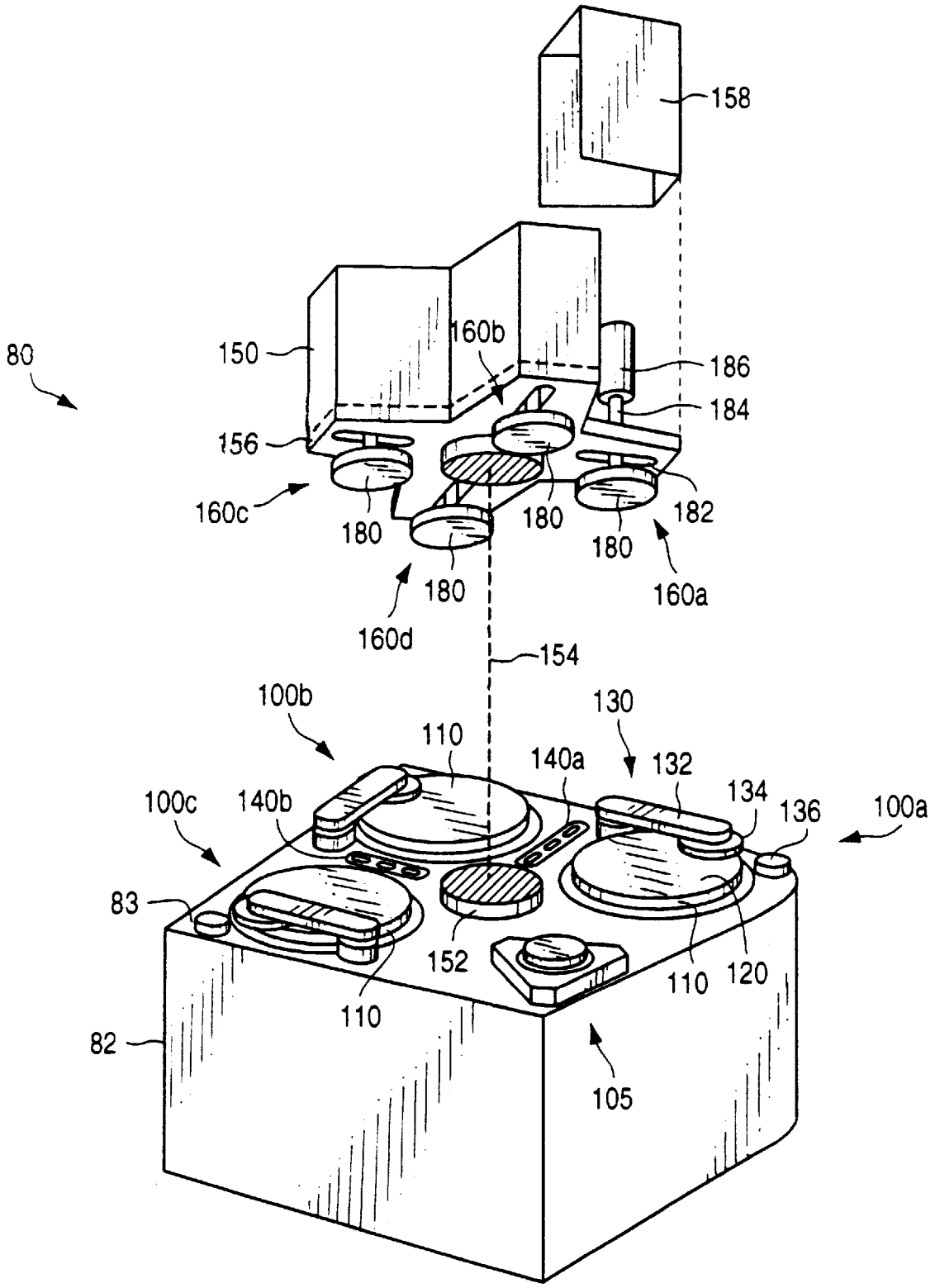
FIG. 4 is a schematic exploded perspective view of the chemical mechanical polishing apparatus of FIG. 3.

Polishing apparatus 80 includes a lower machine base 82 with a table top 83 mounted thereon and removable upper outer cover (not shown). As best seen in FIG. 4, table top 83 supports a series of polishing stations 100*a*, 100*b* and 100*c*, and a transfer station 105. Transfer station 105 forms a generally square arrangement with the three polishing stations 100*a*, 100*b* and 100*c*. Transfer station 105 serves multiple functions of receiving individual substrates 10 from loading apparatus 60, washing the substrates, loading the substrates into carrier heads (to be described below), receiving the substrates from the carrier heads, washing the substrates again, and finally transferring the substrates back to loading apparatus 60 which returns the substrates to the cassette.

Each polishing station 100*a*, 100*b*, or 100*c* includes a rotatable platen 110 on which is placed a polishing pad 120. Each polishing station 100*a*, 100*b* and 100*c* may further include an associated pad conditioner apparatus 130. Each pad conditioner apparatus 130 has a rotatable arm 132 holding an independently rotating conditioner head 134 and an associated washing basin 136. The conditioner apparatus maintains the condition of the polishing pad so it will effectively polish any substrate pressed against it while it is rotating.

Two or more intermediate washing stations 140*a* and 140*b* are positioned between neighboring polishing stations 100*a*, 100*b*, 100*c* and transfer station 105. The washing stations rinse the substrates as they pass from one polishing station to another.

A rotatable multi-head carousel 150 is positioned above lower machine base 82. Carousel 150 is supported by a center post 152 and rotated thereon about a carousel axis 154 by a carousel motor assembly located within base 82. Center post 152 supports a carousel support plate 156 and a cover 158. Multi-head carousel 150 includes four carrier head systems 160*a*, 160*b*, 160*c*, and 160*d*. Three of the carrier head systems receive and hold a substrate, and polish it by pressing it against the polishing pad 120 on platen 110 of polishing stations 100*a*, 100*b* and 100*c*. One of the carrier head systems receives substrates from and delivers substrates to transfer station 105.

In the preferred embodiment, the four carrier head systems 160*a*–160*d* are mounted on carousel support plate 156 at equal angular intervals about carousel axis 154. Center post 152 supports carousel support plate 156 and allows the carousel motor to rotate the carousel support plate 156 and to orbit the carrier head systems 160*a*–160*d*, and the substrates attached thereto, about carousel axis 154.

Each carrier head system 160*a*–160*d* includes a polishing or carrier head 180. Each carrier head 180 independently rotates about its own axis, and independently laterally oscillates in a radial slot 182 formed in support plate 156. A carrier drive shaft 184 connects a carrier head rotation motor 186 to carrier head 180 (shown by the removal of one-quarter of cover 158). There is one carrier drive shaft and motor for each head.

The substrates attached to the bottom of carrier heads 180 may be raised or lowered by the polishing head systems 160*a*–160*d*. An advantage of the overall carousel system is that only a short vertical stroke is required of the polishing head systems to accept substrates, and position them for polishing and washing. An input control signal (e.g., a pneumatic, hydraulic, or electrical signal), causes expansion or contraction of carrier head 180 of the polishing head systems in order to accommodate any required vertical stroke. Specifically, the input control signal causes a lower carrier member having a wafer receiving recess to move vertically relative to a stationary upper carrier member.

During actual polishing, three of the carrier heads, e.g., those of polishing head systems 160*a*–160*c*, are positioned at and above respective polishing stations 100*a*–100*c*. Each rotatable platen 110 supports a polishing pad 120 with a top surface which is wetted with an abrasive slurry. Carrier head 180 lowers a substrate to contact polishing pad 120, and the abrasive slurry acts as the media for both chemically and mechanically polishing the substrate or wafer.

After each substrate is polished, polishing pad 120 is conditioned by conditioning apparatus 130. Arm 132 sweeps conditioner head 134 across polishing pad 120 in an oscillatory motion generally between the center of polishing pad 120 and its perimeter. Conditioner head 134 includes an abrasive surface, such as a nickel-coated diamond surface. The abrasive surface of conditioner head 134 is pressed against rotating polishing pad 120 to abrade and condition the pad.

In use, the polishing head 180, for example, that of the fourth carrier head system 160*d*, is initially positioned above the wafer transfer station 105. When the carousel 150 is rotated, it positions different carrier head systems 160*a*, 160*b*, 160*c*, and 160*d* over the polishing stations 100*a*, 100*b* and 100*c*, and the transfer station 105. The carousel 150 allows each polishing head system to be sequentially located, first over the transfer station 105, and then over one or more of the polishing stations 100*a*–100*c*, and then back to the transfer station 105.

Figure 5A:
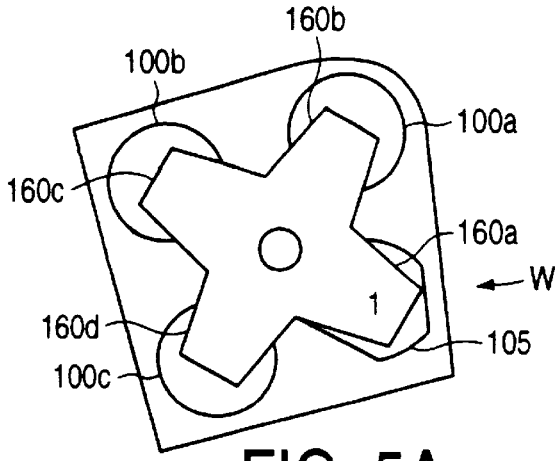
FIGS. 5A–5F are schematic top views of the polishing apparatus illustrating the progressive movement of wafers as they are sequentially loaded and polished.
Figure 5B:
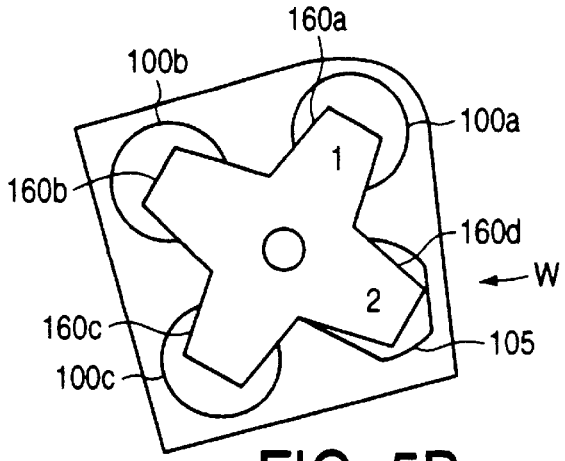
Figure 5C:
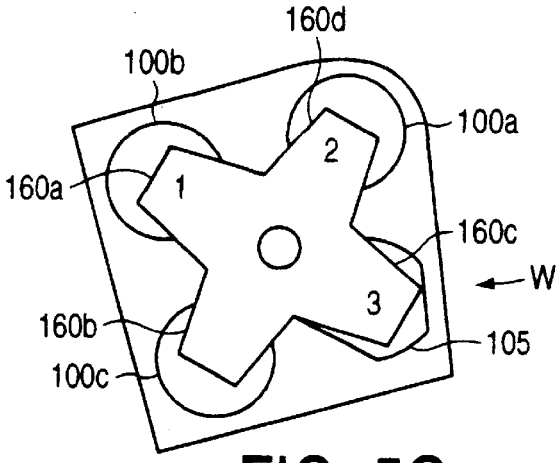
Figure 5D:
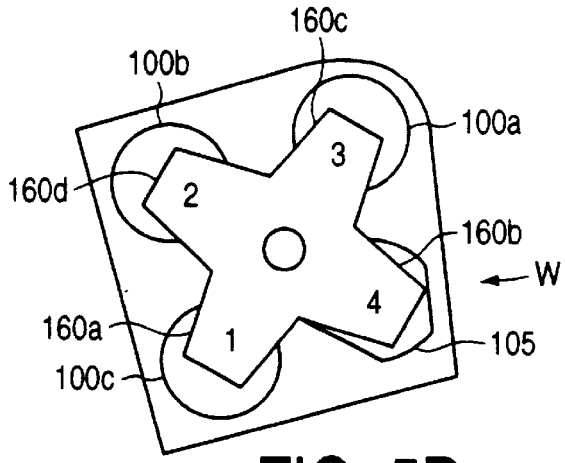
Figure 5E:
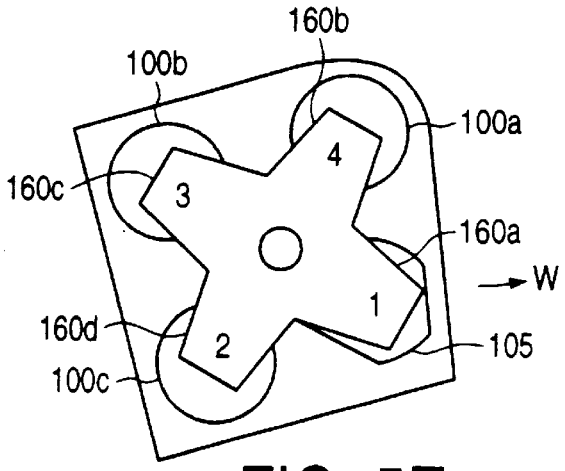
Figure 5F:
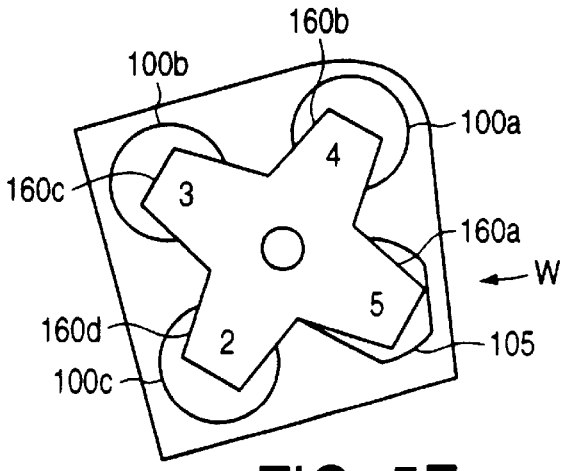

FIGS. 5A–5F show the carrousel 150 and its movement with respect to the insertion of a substrate such as a wafer (W) and subsequent movement of carrier head systems 160*a*–160*d*. As shown in FIG. SA, a first wafer W#1 is loaded from loading apparatus 60 into transfer station 105, where the wafer is washed and then loaded into a carrier head 180, e.g., that of a first carrier head system 160*a*. Carousel 150 is then rotated counter-clockwise on supporting center post 152 so that, as shown in FIG. 5B, first carrier head system 160*a* with wafer W#1 is positioned at the first polishing station 100*a*, which performs a first polish of wafer W#1. While first polishing station 100*a* is polishing wafer W#1, a second wafer W#2 is loaded from loading apparatus 60 to transfer station 105 and from there to a second carrier head system 160*b*, now positioned over transfer station 105. Then carousel 150 is again rotated counter-clockwise by 90° so that, as shown in FIG. 5C, first wafer W#1 is positioned over second polishing station 100*b* and second wafer W#2 is positioned over first polishing station 100*a*. A third carrier head system 100*c* is positioned over transfer station 105, from which it receives a third wafer W#3 from loading system 60. In a preferred embodiment, during the stage shown in FIG. 5C, wafer W#1 at second polishing station 100*b* is polished with a slurry of finer grit than wafer W#1 at the first polishing station 100*a*. In the next stage, as illustrated by FIG. 5D, carousel 150 is again rotated counter-clockwise by 90° so as to position wafer W#1 over third polishing station 100*c*, wafer W#2 over second polishing station 100*c*, and wafer W#3 over first polishing station 100*a*, while a fourth carrier head system 160*d* receives a fourth wafer W#4 from loading apparatus 60. The polishing at third polishing station 100*c* is presumed to be even finer than that of second polishing station 100*b*. After the completion of this stage, carousel 150 is again rotated. However, rather than rotating it counter-clockwise by 90°, carousel 150 is rotated clockwise by 270°. By avoiding continuous rotation in one direction, carousel 150 may use simple flexible fluid and electrical connections rather than complex rotary couplings. The rotation, as shown in FIG. 5E, places wafer W#1 over transfer station 105, wafer W#2 over third polishing station 100*c*, wafer W#3 over second polishing station 100*b*, and wafer W#4 over first polishing station 100*a*. While wafers W#1–W#3 are being polished, wafer W#1 is washed at transfer station 105 and returned from carrier head system 160*a* to loading apparatus 60. Finally, as illustrated by FIG. 5F, a fifth wafer W#5 is loaded into first carrier head system 160*a*. After this stage, the process is repeated.

Figure 6:
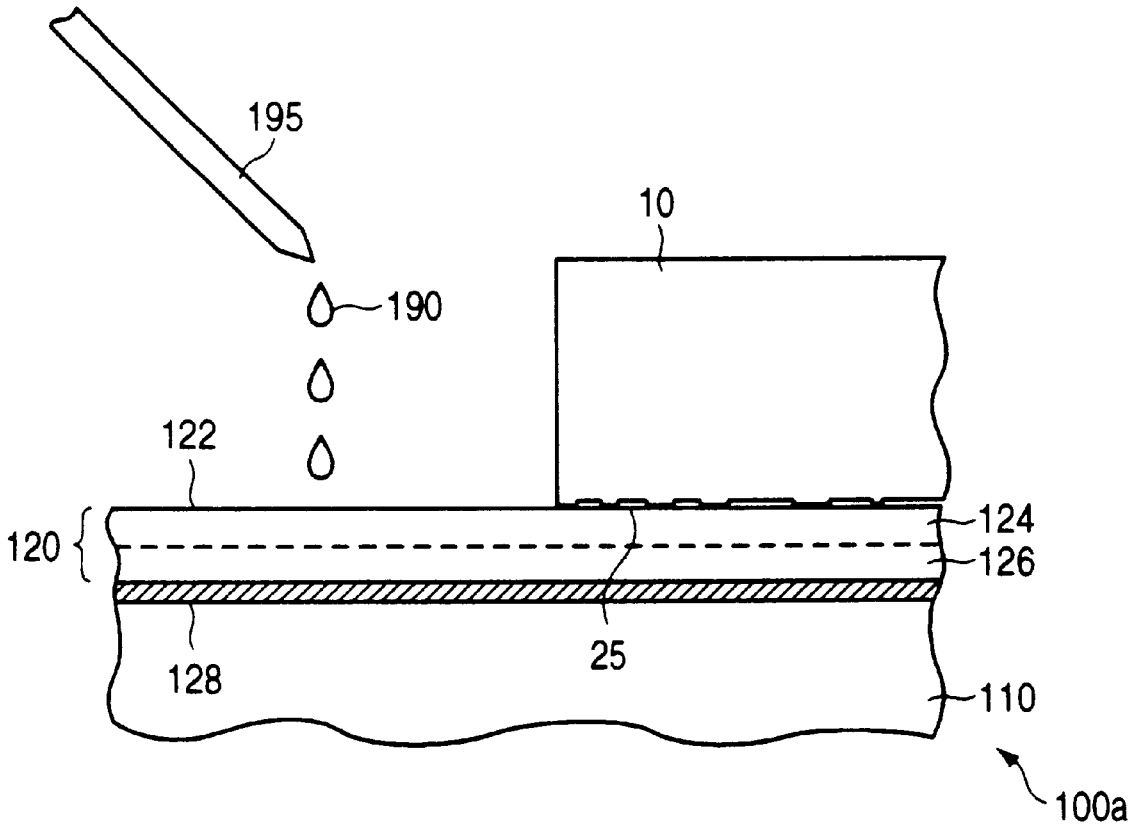
FIG. 6 is a schematic side view of a substrate on a polishing pad.

As shown in FIG. 6, a carrier head system, such as system 160*a*, lowers substrate 10 to engage a polishing station, such as polishing station 100*a*. As noted, each polishing station includes a rigid platen 110 supporting a polishing pad 120. If substrate 10, is an eight-inch (200 mm) diameter disk, then platen 110 and polishing pad 120 will be about twenty inches in diameter. Platen 110 is preferably a rotatable aluminum or stainless steel plate connected by stainless steel platen drive shaft (not shown) to a platen drive motor (not shown). For most polishing processes, the drive motor rotates platen 120 at thirty to two-hundred revolutions per minute, although lower or higher rotational speeds may be used.

Polishing pad 120 is a hard composite material with a roughened surface 122. Polishing pad 120 may have a fifty mil thick hard upper layer 124 and a fifty mil thick softer lower layer 126. Upper layer 124 is preferably a material composed of polyurethane mixed with other fillers. Lower layer 126 is preferably a material composed of compressed felt fibers leached with urethane. A common two-layer polishing pad, with the upper layer composed of IC-1000 and the lower layer composed of SUBA-4, is available from Rodel, Inc., located in Newark, Del. (IC-1000 and SUBA-4 are product names of Rodel, Inc.). In one embodiment, polishing pad 120 is attached to platen 110 by a pressure-sensitive adhesive layer 128.

Each carrier head system includes a rotatable carrier head. The carrier head holds substrate 10 with the top surface 22 pressed face down against outer surface 122 of polishing pad 120. For the main polishing step, usually performed at station 100*a* carrier head 180 applies a force of approximately four to ten pounds per square inch (psi) to substrate 10. At subsequent stations, carried head 180 may apply more or less force. For example, for a final polishing step, usually performed at station 100*c*, carrier head 180 applies about three psi. Carrier drive motor 186 (see FIG. 4) rotates carrier head 180 at about thirty to two-hundred revolutions per minute. In a preferred embodiment, platen 110 and carrier head 180 rotate at substantially the same rate.

A slurry 190 containing a reactive agent (e.g., deionized water for oxide polishing), abrasive particles (e.g., silicon dioxide for oxide polishing) and a chemically reactive catalyzer (e.g., potassium hydroxide for oxide polishing), is supplied to the surface of polishing pad 120 by a slurry supply tube 195. Sufficient slurry is provided to cover and wet the entire polishing pad 120.

As mentioned above, polishing pad 120 becomes "glazed" during the chemical mechanical polishing process. This glazing effect is primarily caused by two phenomena: accumulation of spent slurry in the porous surface of the polishing pad, and compression of the porous surface of the pad due to the loading of the substrate against the pad. A glazed polishing pad has a lower coefficient of friction, and thus a substantially lower polishing rate, than a "fresh" or un-glazed pad. As the polishing rate drops, the time required to polish a substrate increases, and the throughput of substrates through the polishing apparatus decreases. In addition, because the polishing pad becomes slightly more glazed after each successive polishing operation, it polishes each successive substrate differently. Therefore, it must be periodically conditioned to provide a consistently rough pad surface.

The conditioning process physically abrades surface 122 of polishing pad 120 to restore its roughness. This abrasion "wears" the pad; i.e., it removes material from the surface of the polishing pad. The wear on the polishing pad can be non-uniform. This is because conditioner apparatus 130 (see FIG. 3) may remove more material from polishing pad 120 in some regions than in others.

The non-uniform thickness of the pad affects the substrate polishing rate. When surface 22 of substrate 10 (see FIG. 6) is pressed against surface 122 of polishing pad 120, the thinner areas of the polishing pad are compressed less than the thicker areas, and therefore the thinner areas exert less pressure on the substrate. Consequently, the thinner areas of the polishing pad will polish a substrate at a slower rate than the thicker areas. Therefore, the non-uniform thickness of a polishing pad may generate a non-uniform substrate outer layer. In view of the foregoing, it is desirable to provide a conditioner apparatus which wears the polishing pad evenly to create a substantially uniform planar surface 122.

Figure 7:
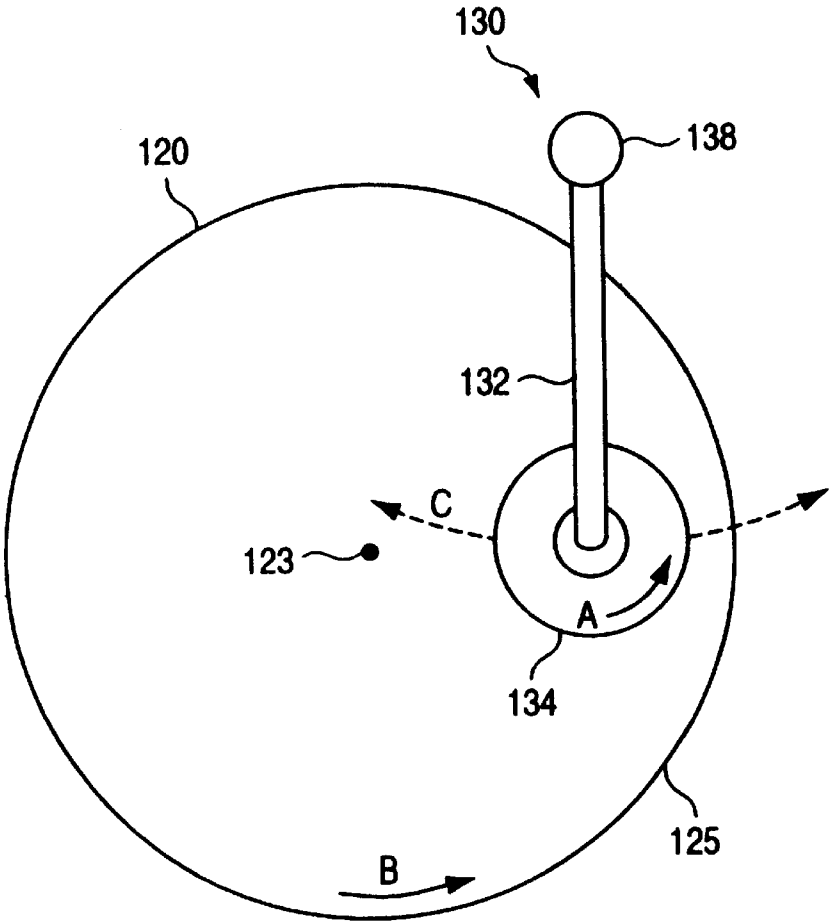
FIG. 7 is a schematic diagram of a conditioner apparatus with a circular conditioner disk.

As shown in FIGS. 3 and 7, in one configuration, the conditioner apparatus includes a circular conditioner 134. One end of arm 132 is connected to circular conditioner 134, and the other end of arm 132 is connected to an oscillating drive 138 which is mounted to table top 83. A drive belt inside arm 132 connects circular conditioner 134 to a drive motor (not shown) to rotate the circular conditioner at thirty to two-hundred rpm in the direction indicated by arrow "A". While circular conditioner 134 is rotating, polishing pad 120 rotates in the direction indicated by arrow "B". The rotational rate of circular conditioner 134 and polishing pad 120 are comparable. Simultaneously, oscillating drive 138 sweeps circular conditioner 134 along the arc "C", between a center 123 and an edge 125 of polishing pad 120.

Figure 8:
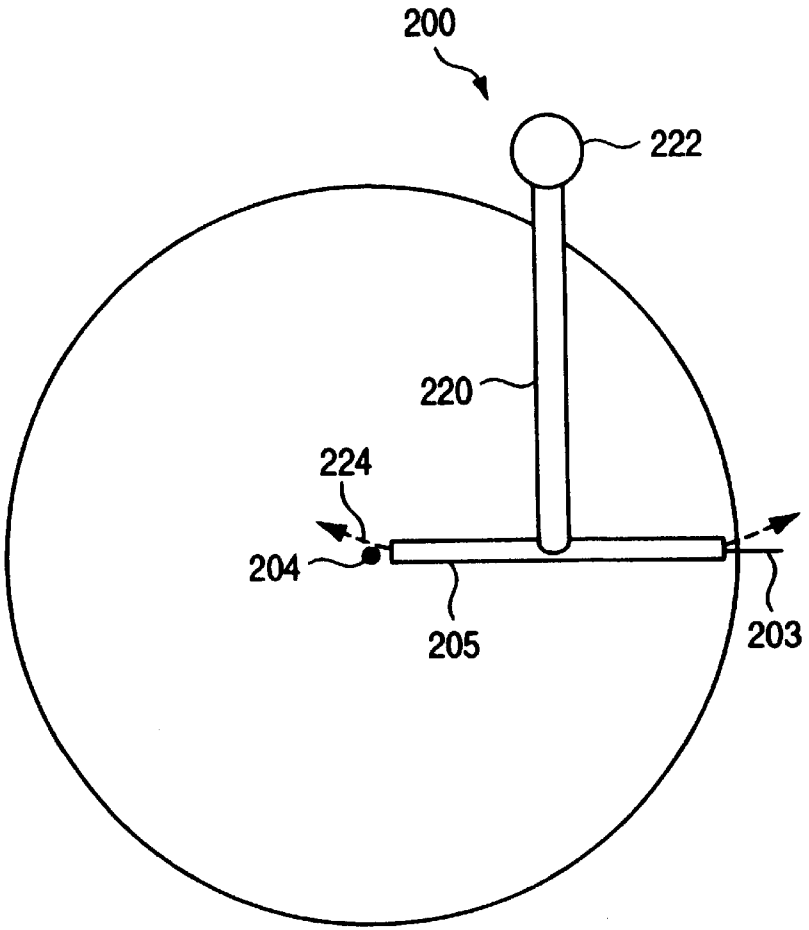
FIG. 8 is a schematic diagram of a conditioner apparatus using a linear conditioner rod according to the present invention.

As shown in FIG. 8, a conditioner apparatus 200 according to the present invention includes a linear conditioner rod 205. Linear conditioner rod 205 makes contact with polishing pad 120 along a linear segment which crosses almost an entire radius of the polishing pad. In this embodiment, linear conditioner rod 205 extends along a radial segment 203 which passes through a center 204 of polishing pad 120. Linear conditioner rod 205 conditions almost the entire radius of the polishing pad with each pad rotation. Thus, as explained below, conditioner apparatus 200 wears the entire polishing pad evenly, producing a very flat polishing pad surface.

Figure 9A:
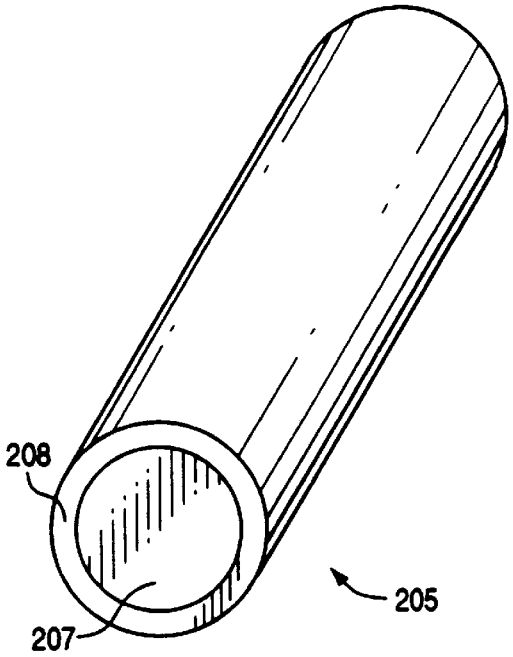
FIGS. 9A and 9B are schematic perspective views of a conditioner rod in the conditioner apparatus of the present invention.

As shown in FIG. 9A, linear conditioner rod 205 may include a stainless steel cylinder 207 coated with an abrasive layer 208. Abrasive layer outer 208 is formed of small, hard, corrosion-resistant abrasive particles, e.g., fifty micron diameter diamonds coated with a thin layer of nickel. If conditioner rod 205 is pressed against a rotating polishing pad 120, the abrasive particles in layer 208 gouge grooves in the surface of the polishing pad.

Conditioner rod 205 is slightly shorter than the radius of polishing pad 120. For example, if polishing pad 120 has an eleven inch radius, then conditioner rod 205 is about ten inches long. Conditioner rod 205 may have a diameter of about one half of an inch.

Alternately, conditioner rod 205 could have a square or trapezoid cross-section. The surface of conditioner rod 205 that contacts polishing pad 120 need not be flat, so long as it makes contact with the polishing pad in a thin radial strip.

Figure 9B:
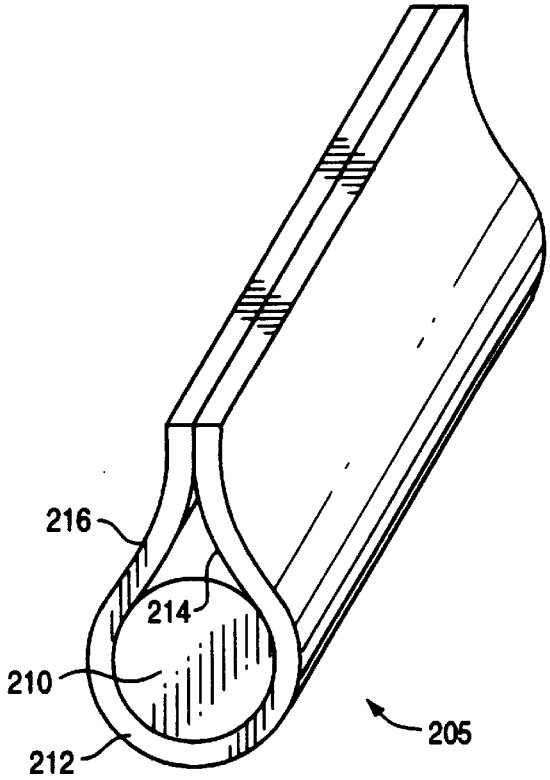

As shown in FIG. 9B, in another embodiment, conditioner rod 205 includes a stainless steel cylinder 210 wrapped with a tape 212. Tape 212 has an adhesive inner surface 214 and an abrasive outer surface 216. When abrasive outer surface 216 has been worn smooth by friction with polishing pad 120, tape 212 is peeled from cylinder 210, and a new piece of tape is attached. The embodiment illustrated by FIG. 9B provides potential cost savings over the embodiment of FIG. 9A, because only the tape, instead of the entire rod, is consumed in the conditioning process.

Returning to FIG. 8, linear conditioner rod 205 is rigidly connected to an arm 220, which is itself connected to an oscillating drive 222. Oscillating drive 222 sweeps linear conditioner rod 205 along an arc 224 while the polishing pad rotates. Oscillating drive 222 performs only a small sweep; i.e., arm 220 rotates by less than five degrees so that linear conditioner rod 205 moves about half an inch.

Figure 10:
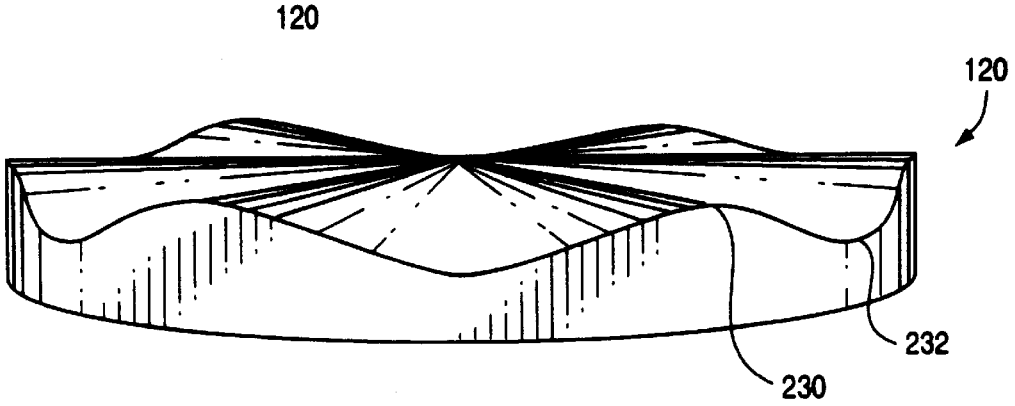
FIG. 10 is a schematic perspective view of a polishing pad which exhibits the "washboarding effect."

One disadvantage of having a single rod conditioner apparatus is that it may create a "washboarding" effect on polishing pad 120, as shown in FIG. 10. The washboarding effect appears as a series of peaks 230 and valleys 232 around the circumference of polishing pad 120. An oscillating pressure from conditioner rod 205 on the rotating polishing pad may create washboarding; valleys 232 appear in areas where conditioner rod 205 applies more pressure and peaks 230 appear in areas where conditioner rod 205 applies less pressure.

Figure 11:
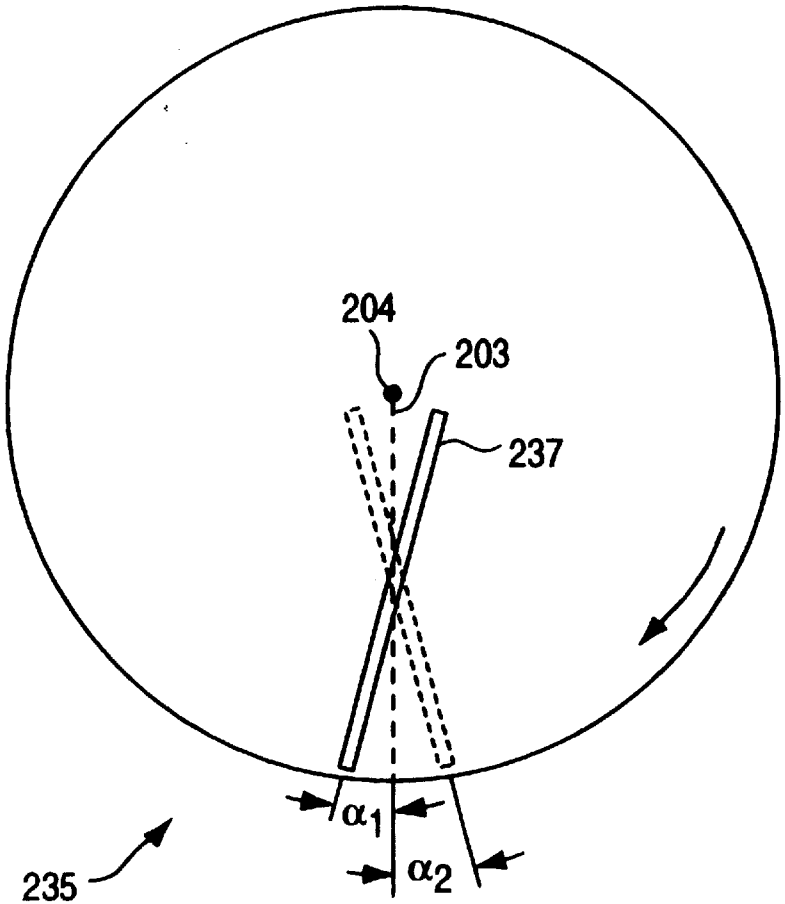
FIG. 11 is a schematic diagram of a conditioner apparatus with an angled linear conditioner rod according to the present invention.

As shown in FIG. 11, in another embodiment, a conditioner apparatus 235 is operated such that linear conditioner rod 237 is at two different angles during the conditioning process. For the first half of the conditioning process, for example, the longitudinal axis of linear conditioner rod 237 forms an angle $\alpha_1$of about 5° from radial segment 203. For the second half of the conditioning process, linear conditioner rod 237 is "flipped" across radial segment 203 (this position is shown in FIG. 10 by dotted lines). In this orientation, the linear conditioner rod forms an angle $\alpha_2$ with radial segment 203. Preferably angle $\alpha_2$ is equal to angle $\alpha_2$. By reversing the position of the linear conditioner rod, any surface non-uniformities created in the first half of the conditioning process are cancelled in the second half of the process. Conditioner rod 237 may be pivotally attached to an arm so that it may move between angle $\alpha_1$ and angle $\alpha_2$. However, the conditioner rod may be fixed so that it does not pivot while the polishing pad is rotating.

Figure 12:
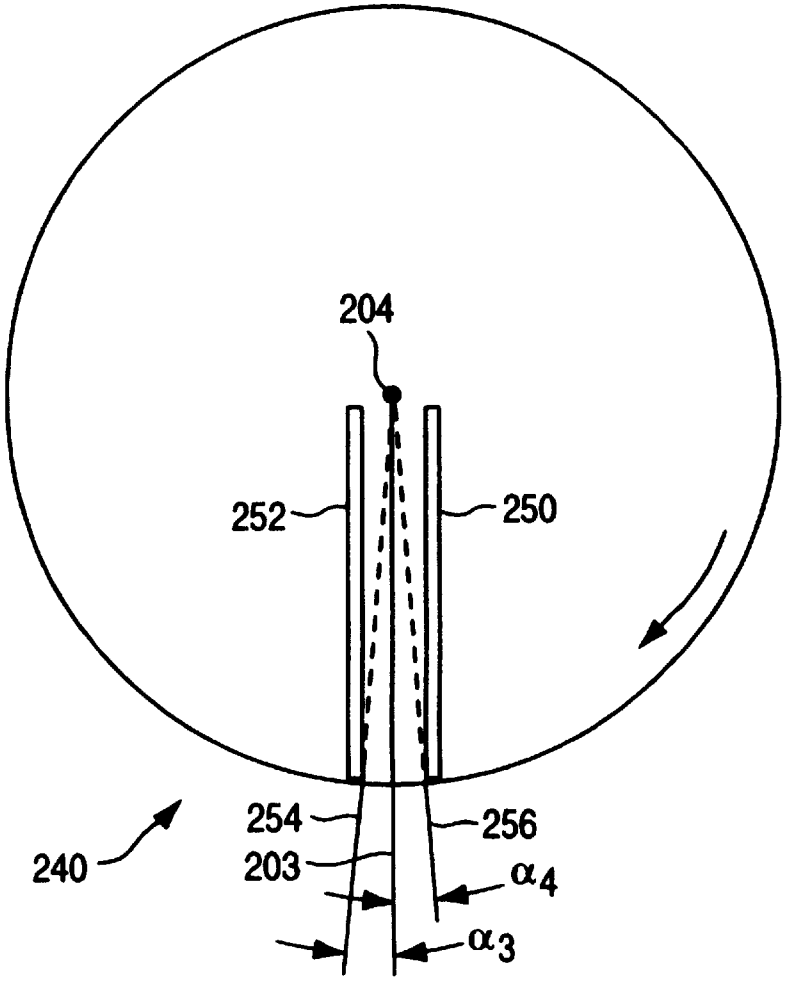
FIG. 12 is a schematic diagram of a conditioner apparatus using two linear conditioner rods according to the present invention.

In the preferred embodiment, as shown in FIG. 12, and as described in more detail below, a conditioner apparatus 240 uses two linear conditioners rods 250 and 252. Linear conditioner rods 250 and 252 form angles $\alpha_3$ and $\alpha_4$, each of about five degrees, with radial segments 256 and 258, respectively, extending from the center of the polishing pad. The two linear conditioners rods 250 and 252 are positioned parallel and equidistant from a radial center line 203. Linear conditioner rods 250 and 252 may be configured as described above with reference to FIGS. 9A or 9B.

Figure 13:
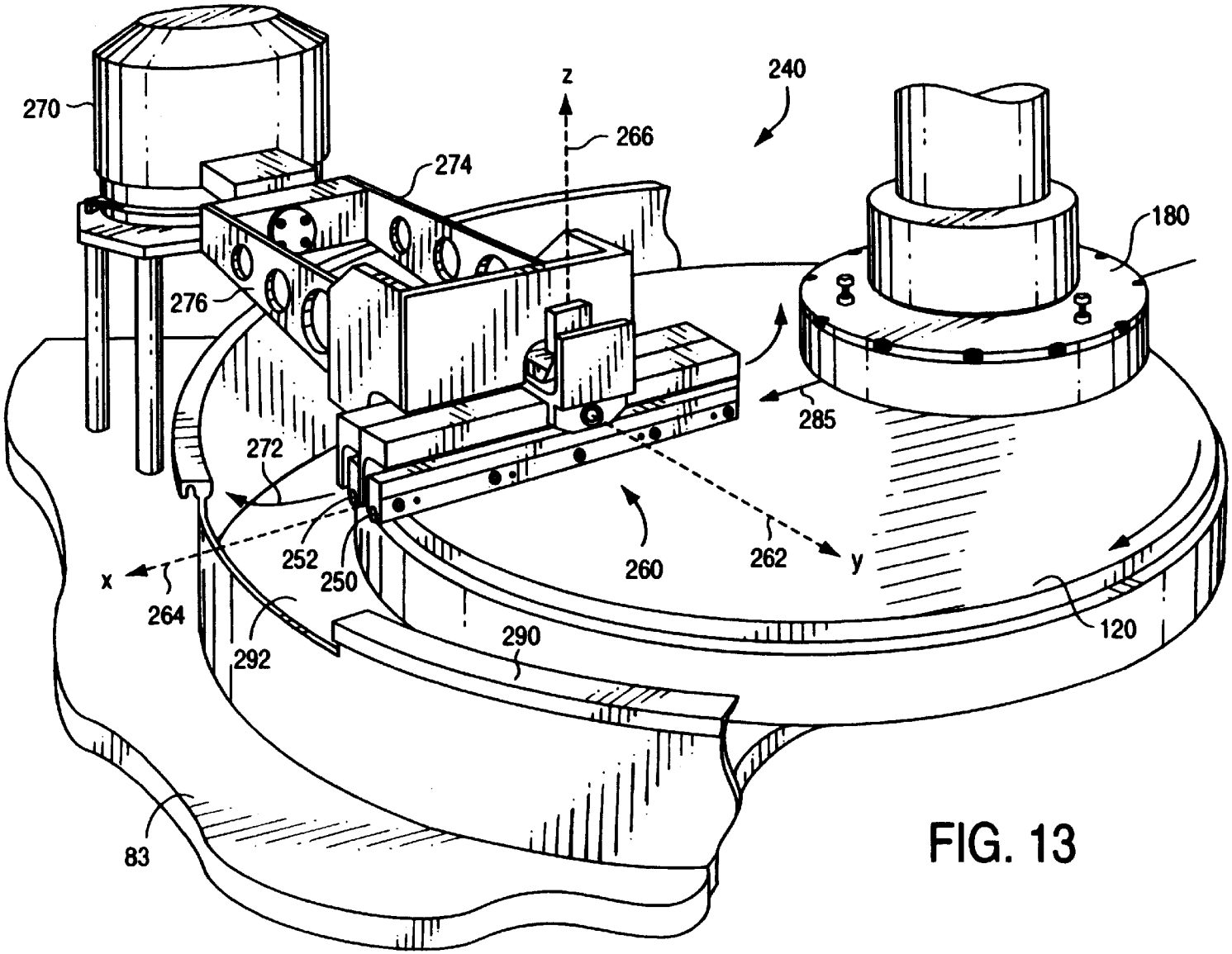
FIG. 13 is a schematic perspective view of the conditioner apparatus of FIG. 12.

As shown in FIG. 13, conditioner apparatus 240 may include a carriage assembly 260 to hold and control the motion of conditioner rods 250 and 252. Carriage assembly 260 will be described in detail below with reference to FIGS. 14–16. The purpose of carriage assembly 260 is to hold conditioner rods 250 and 252 against polishing pad 120. Carriage assembly 260 also controls the rotational freedom of the conditioner rods. The conditioner rods can pivot independently about a lateral y-axis 262. They also can pivot together about a radial x-axis 264, which is parallel to the longitudinal axes of the conditioner rods and is located in the plane of the polishing pad. However, the conditioner rods can not pivot about a vertical z-axis 266. Thus, the conditioner rods will not pivot in the same plane as the polishing pad, but they will be parallel to the polishing pad. The rotation about x-axis 264 improves the polishing uniformity. If there are circumferential non-uniformities, such as washboarding, then when one rod lifts up, the other rod is pressed down against the polishing pad surface. This ensures that both rods are pressed against the surface of the polishing pad to create a uniform pressure.

An air cylinder 270 is provided to sweep the conditioner rods along an arc 272 which is tangent to radial segment 203 (see FIG. 12). Air cylinder 270 also provides a controllable downward pressure to press the conditioner rods against the polishing pad. Air cylinder 270 is mounted to table top 83 of polishing apparatus 80. Two arms 274 and 276 connect carriage assembly 260 to air cylinder 270. When air cylinder 270 rotates, arms 274 and 276 carry carriage assembly 260 along arc 272 toward the center or edge of polishing pad 120. Air cylinder 270 moves conditioner rods 250 and 252 about half an inch along arc 272. When air cylinder 270 moves downwardly, arms 274 and 276 lower carriage assembly 260 to press the conditioner rods against the polishing pad. The two arms on either side of carriage assembly 260 are balanced to apply a uniform downward force to each conditioner rod.

During the conditioning process, conditioner rods 250 and 252 are positioned on polishing pad 120 about 180° around the pad from the carrier head 180. Carrier head 180 sweeps radially along axis 285 without crashing into conditioner apparatus 240. When carousel 150 turns, support plate 156 or cover 158 may strike conditioner apparatus 240. Therefore, when the conditioning process is complete, air cylinder 270 lifts the conditioner rods off the polishing pad and rotary motor 270 swings them over table top 83. If a splash plate 290 surrounds polishing pad 120 to collect slurry that is spun off the pad by centrifugal force, then an opening 292 may be cut in the splash plate to allow conditioner rods 250 and 252 to swing partly over the table top and out of the way of carousel 150.

Figure 14A:
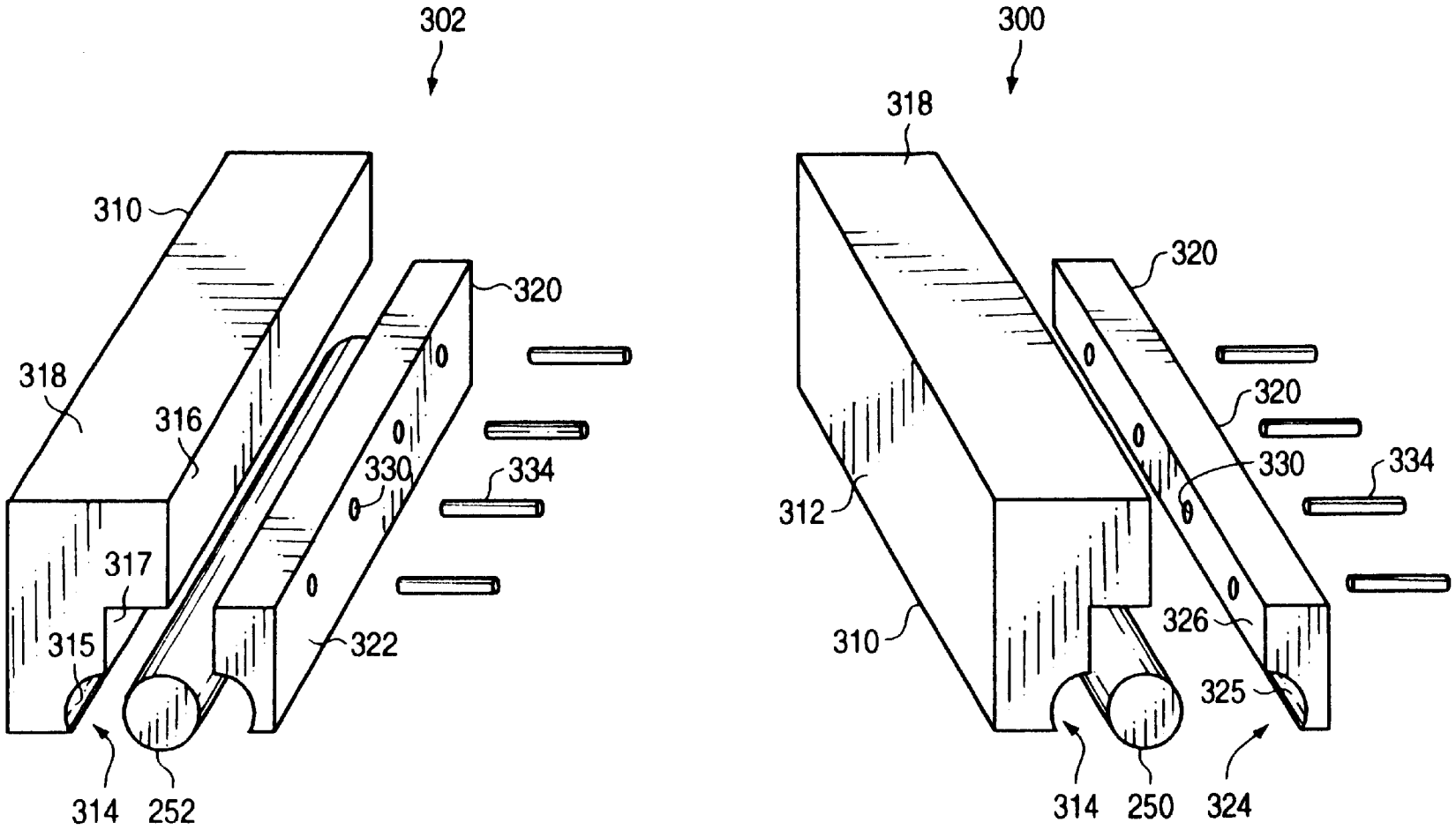
FIGS. 14A, 14B and 14C are schematic perspective exploded views of a carriage assembly for a conditioner apparatus having two conditioner rods in accordance with the present invention.
Figure 14B:
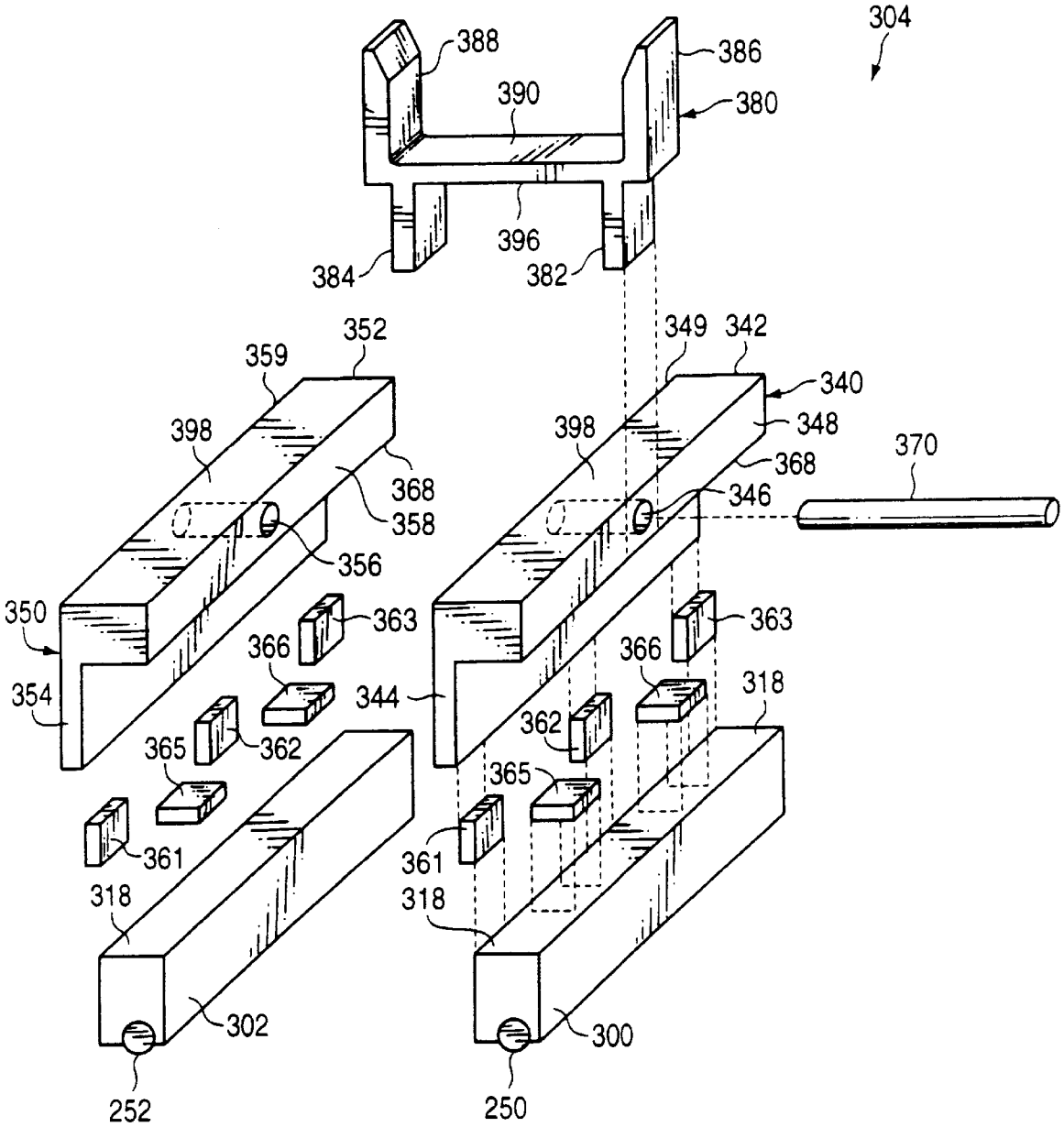
Figure 14C:
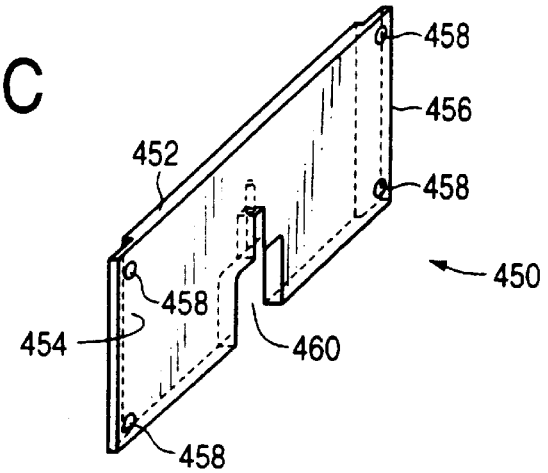
Figure 14C:
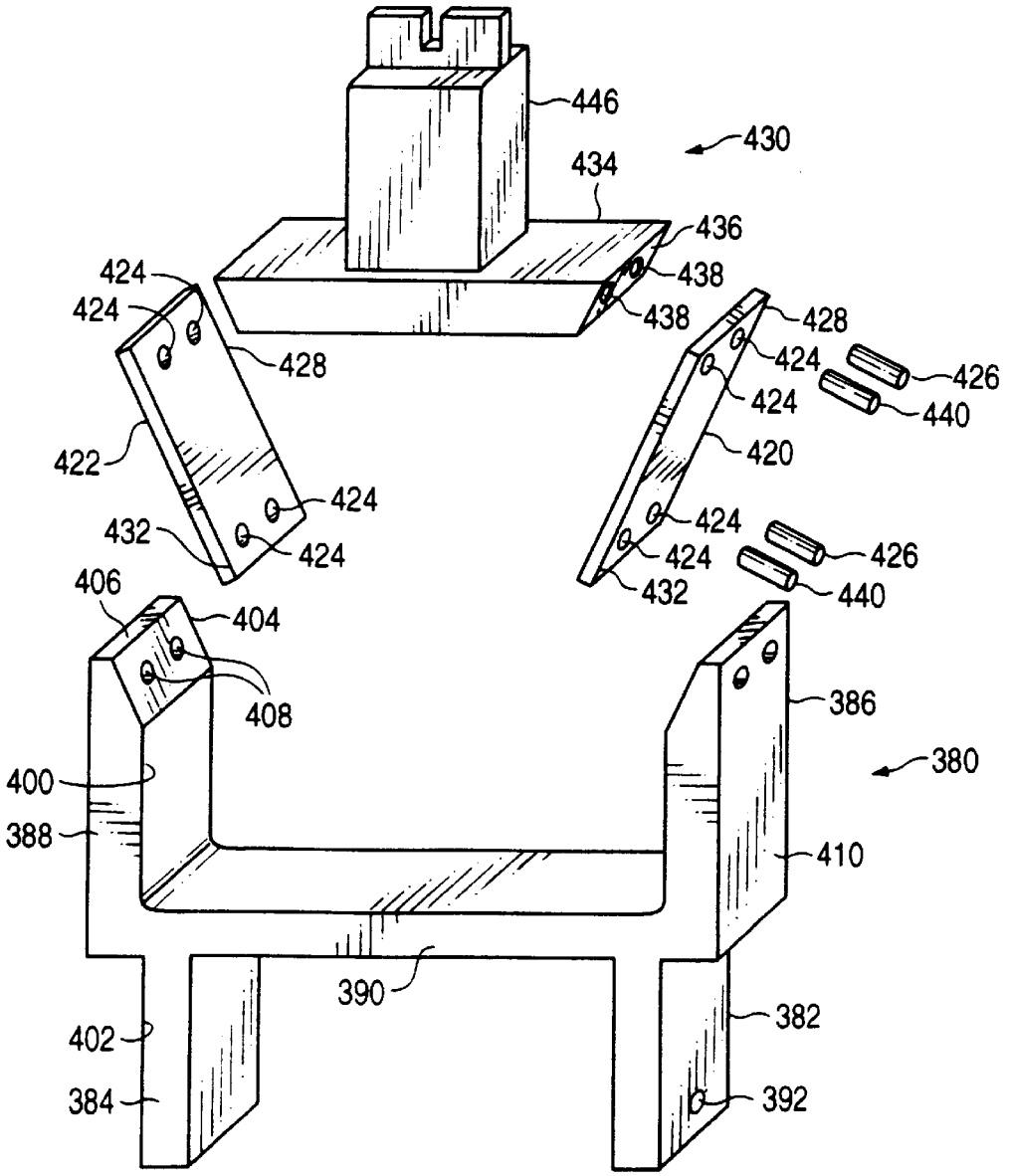

One embodiment of carriage assembly 260 illustrated in FIGS. 14A–14C includes a "leading" mounting apparatus 300 (see FIG. 14A), a "trailing" mounting apparatus 302 (see FIG. 14A), a pin connection 304 (see FIG. 14B) and a flexure connection 306 (see FIG. 14C). Leading mounting apparatus 300 holds leading conditioner rod 250, and trailing mounting apparatus 302 holds trailing conditioner rod 252. Rotating polishing pad 120 contacts leading conditioner rod 250 before it contacts trailing conditioner rod 252. Pin connection 304 and flexure connection 306 provide the gimbal mechanism for the conditioner rods.

As shown in FIG. 14A, the mounting apparatus 300 and 302 are constructed similarly. Each includes a rod holder 310 and a matching clamp bracket 320 to hold a conditioner rod. Rod holder 310 is an elongated member, about the same length as the conditioner rod, with a flat outer vertical side 312 and a tiered inner vertical side 314. From its lower edge, tiered vertical side 314 has a curved surface 315, a flat projection 316, and a ledge 317 between curved surface 315 and projection 316. Each clamp bracket 320 is also an elongated member, about the same length as its corresponding rod holder. The outer side 322 of each clamp bracket is flat, but the inner side of 324 each clamp bracket has a curved surface 325 and a projection 326. Conditioner rod 250 is held tightly between curved surfaces 315 and 325 of the rod holder and clamp bracket (see FIG. 15).

Passages 330 extend through clamp bracket 320, and matching threaded recesses 332 are formed in ledge 317 of the rod holder. To attach a clamp bracket to its matching rod holder, screws 334 pass through passages 330 and engage threaded recesses 332 in ledge 217 (see FIG. 15).

Pin connection 304 of carriage assembly 260 allows conditioner rods 250 and 252 to pivot independently around the y-axis. As shown in FIG. 14B, pin connection 304 includes a leading L-shaped bracket 340 and a trailing L-shaped bracket 350. Leading L-shaped bracket includes a horizontal arm 342 and a vertical arm 344. A passage 346 extends through horizontal arm 342 from a forward edge 348 to a back surface 349. Trailing L-shaped bracket 350 is constructed similarly, with a horizontal arm 352, a vertical arm 354, and a lateral passage 356 extending through horizontal arm 352 from forward edge 358 to a back surface 359. When carriage assembly 260 is assembled, forward edge 358 of trailing bracket 350 abuts back surface 349 of leading bracket 340 and lateral passage 346 aligns with lateral passage 356 (see FIG. 15).

Each mounting apparatus 300 and 302 is connected to an associated L-shaped bracket 340 and 350 by rectangular dampers. Each damper is formed of an elastic material, such as rubber, that can absorb vibratory motion. Three dampers 361, 362 and 363 may be positioned between outer surface 308 of rod holder 310 and the inner surface of the vertical arm of the L-shaped bracket. Dampers 361 and 363 may be positioned at the edges of rod holder 310, and damper 362 may be positioned at the center of rod holder 310 (see also FIG. 16). Two dampers 365 and 366 may be positioned between top surface 318 of rod holder 310 and bottom surface 368 of the bracket 342. These two dampers may be positioned equidistant from the center of rod holder 310. The elastic dampers connect the brackets and rod holders with an adhesive.

A pin 370 connects L-shaped brackets 340 and 350 to a flexure hub 380. Flexure hub 380 may be shaped like an "H", with leading and trailing lower flange portions 382 and 384, and leading and trailing upper flange portions 386 and 388. The flanges project from a cross-bar 390. Two circular apertures 392 and 394 extend through lower flanges 382 and 384, respectively (see FIGS. 14C and 15). Lower flanges 382 and 384 fit closely, but with minimal friction, around the outer edges of brackets 340 and 350. Pin 370 fits through aperture 392, passage 346 of leading bracket 340, passage 356 of trailing bracket 350, and aperture 394 to secure brackets 340 and 350 to flexure hub 380 (see also FIG. 15). One end of pin 370 may have a head (not shown) which catches against leading flange 382. A cap (not shown) may screw onto the other end of pin 370 to catch against trailing flange 384 and hold the pin in place.

A small gap separates the underside 396 of flexure hub 380 from the top surface 398 of each bracket. This gap allows each bracket, with its attached rod mounting assembly, to pivot around pin 370. Furthermore, because bracket 340 is not fixed to bracket 350, the two brackets can pivot independently.

As shown in FIG. 14C, flexure connection 306 allows conditioner rods 250 and 252 to pivot together around x-axis 264. Thus, if leading conditioner rod 250 rises, then carriage assembly 260 pivots counter-clockwise to move trailing conditioner rod 252 downwardly. Carriage assembly 260 pivots about axis 264 on the surface of polishing pad 120, midway between the two conditioner rods. Additional advantages of flexure connection 306 are that it uses few moving parts and does not become clogged by slurry.

Both upper flanges 386 and 388 have a top edge portion 404 which is beveled on an inner surface 400 to form a diagonal surface 406. The angle of diagonal surface 406 is about 5°. Two bolt-holes 408 extend diagonally through each flange from the outer surface 410 of edge 404 to diagonal surface 406. The bolt-holes form a leading angle with diagonal surface 406.

Carriage assembly 260 includes a leading flexure 420 and a trailing flexure 422. Flexures 420 and 422 are leaf springs, i.e., thin, rectangular, metal sheets. The flexures provide for the rotation of carriage assembly 260 about x-axis 264. The flexures are somewhat flexible, but are not extendable or compressible. Each flexure may have four bolt-holes 424, one in each corner. Bolts 426 pass through bolt-holes 408 in flexure hub 380 and bolt-holes 424 in flexures 420 and 422 to mount an upper edge 428 of each flexure to diagonal surface 406 of each upper flange.

The carriage assembly 260 also includes a flex tie 430. Flex tie 430 connects the lower edges 432 of the leading and trailing flexures. The general purpose of the flex tie is to transfer downward pressure from arms 274 and 276 to the flexures. Flex tie 430 includes a trapezoidalshaped base 434 with inwardly sloped surfaces 436. Each sloped surface 436 has recesses 438. Bolts 440 pass through the bolt holes 424 along lower edge 432 of flexures 420 and 422 and into recesses 438 to mount the lower edge of the flexures to the flex tie. The top surface 442 of flex tie 430 may include a projection 446.

A cross-bracket 450 connects arms 274 and 276 to carriage assembly 260. Cross-bracket 450 includes a solid rectangular member 452 disposed parallel to x-axis 264 above polishing pad 120. Two wings 454 and 456 project outwardly from the sides of member 452 to catch the forward edge of the arms 274 and 276. Bolts (not shown) pass through bolt-holes 458 in wings 454 and 456 and into recesses (not shown) in the arms to attach cross-bracket 450 to the arms (see FIG. 13). Cross-bracket 450 is bolted or otherwise attached to flex tie 430.

Figure 15:
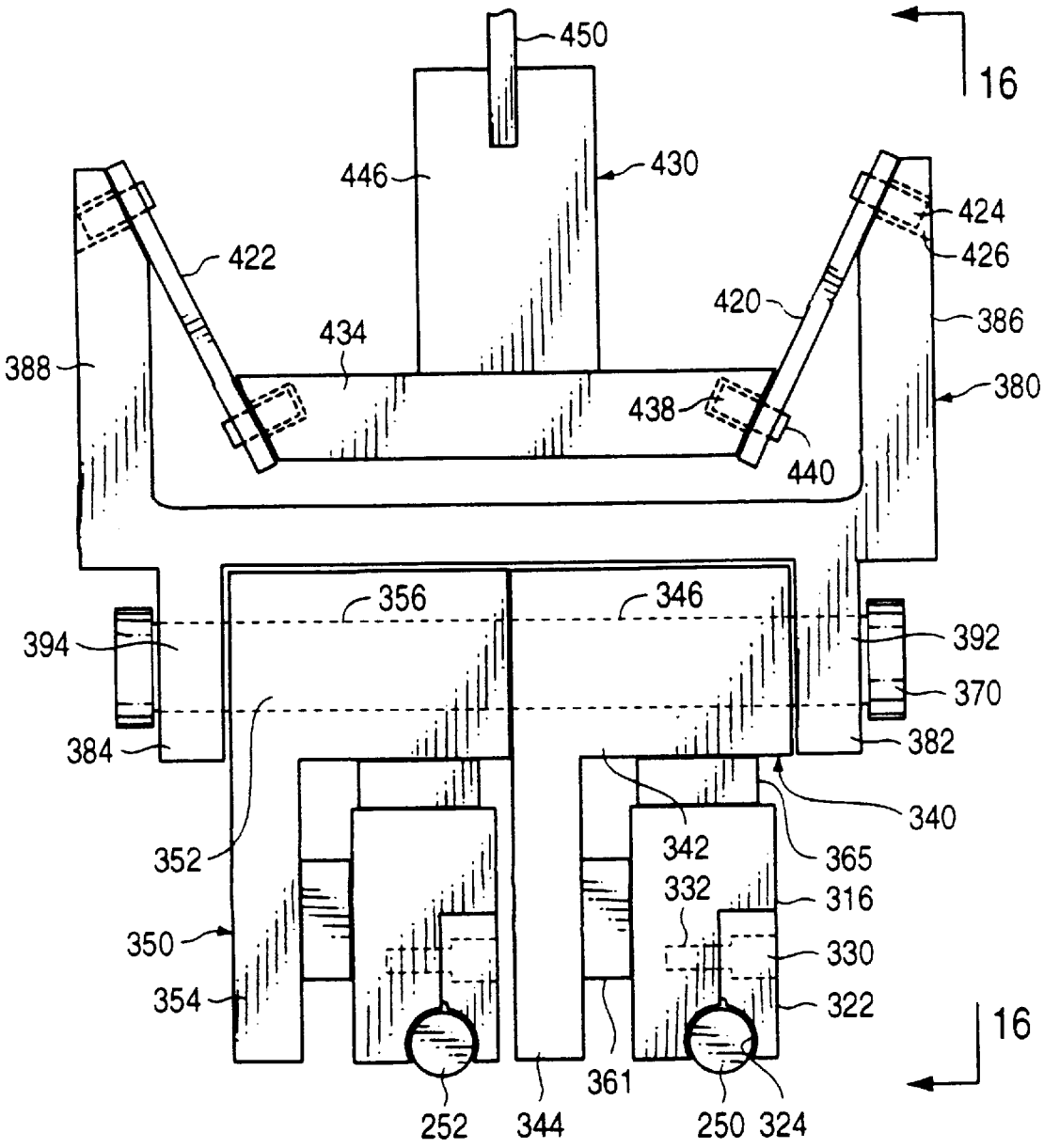
FIG. 15 is a schematic side view of the carriage assembly of FIGS. 14A–14C.
Figure 16:
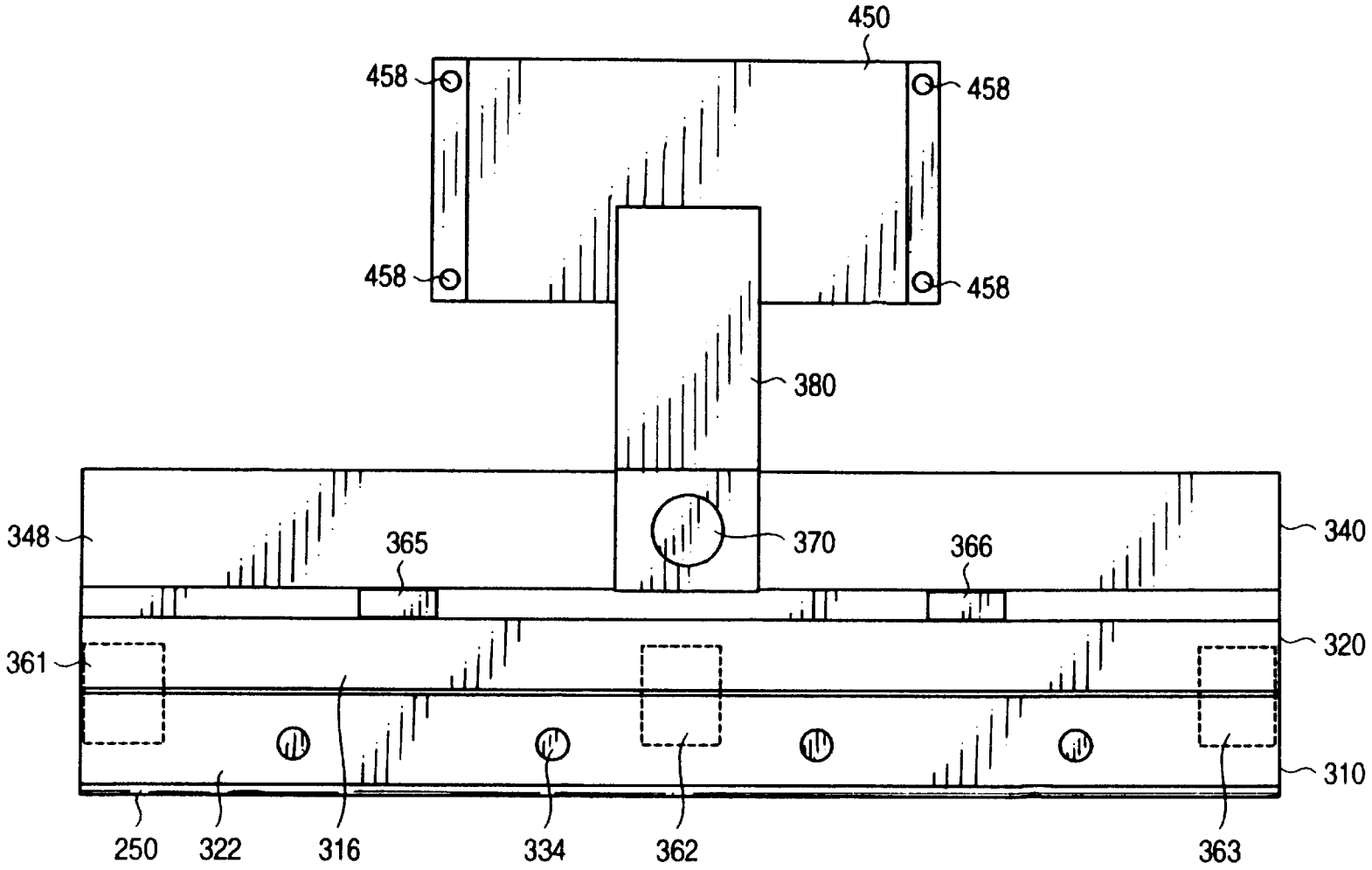
FIG. 16 is a view along line 16—16 of FIG. 15.

As shown in FIG. 15, carriage assembly 260 applies a uniform force on conditioner rods 250 and 252. When air cylinder 270 urges arms 274 and 276 downwardly, cross-bracket 450 presses down on flex tie 430. Flex tie 430 pulls down on flexures 420 and 422, which in turn push down on flexure hub 380. This downward force is transmitted through pin 370 to brackets 340 and 350, and from the brackets through dampers 365 and 366 (shown in FIG. 17) to the mounting apparatus 300 and 302. Finally, the mounting assemblies push conditioner rods 250 and 252 against polishing pad 120.

Mounting apparatus 300 and 302 are oriented so that conditioner rods 250 and 252 are "in front", with respect to rotation of the polishing pad, of their respective dampers 361, 362 and 363. The shear force created by the movement of the conditioner rods over polishing pad 120 presses the mounting assemblies into the dampers, rather than pulling the mounting assemblies away from the dampers.

When the conditioner rods move onto a slope, such as that on the side of peak 230, the leading conditioner rod 250 is pushed upwardwardly. The upward force on conditioner rod 250 causes the upper edge 428 of leading flexure 420 to bend inwardly and the upper edge 428 of trailing flexure 422 to bend outwardly, resulting in a rotation of the entire carriage assembly 260. The rotation of carriage assembly 260 forces the trailing conditioner rod 252 downwardly to contact surface 122 of polishing pad 120. Thus, on a sloped polishing pad, the conditioner apparatus makes firm contact with the polishing pad along two linear strips. The abrasive contact along two parallel segments ensures even pressure and uniform wear on the polishing pad.

Figure 17:
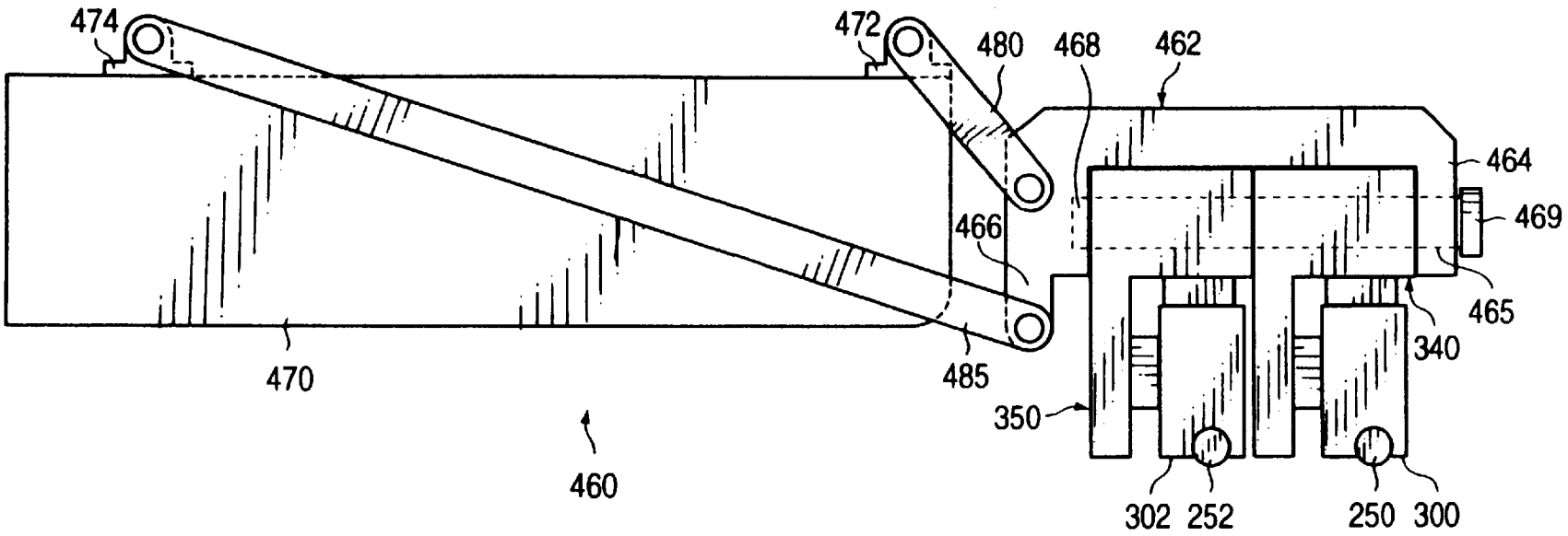
FIG. 17 is a schematic side view of a conditioner apparatus according to the present invention using an off-axis gimbal mechanism.

In an another embodiment, shown in FIG. 17, the rotation of conditioner rods 250 and 252 about the x-axis is provided by an off-axis gimbal mechanism 460. Off-axis gimbal mechanism 460 includes a frame 462 for mounting leading and trailing brackets 340 and 350. Frame 462 has a leading flange 464 with an aperture 465, and a trailing flange 466 with a recess 468 in its inner surface. A pin 469 fits through aperture 465 and passages 346 and 356 and into recess 468 to pivotally mount the trailing and leading brackets.

Figure 18:
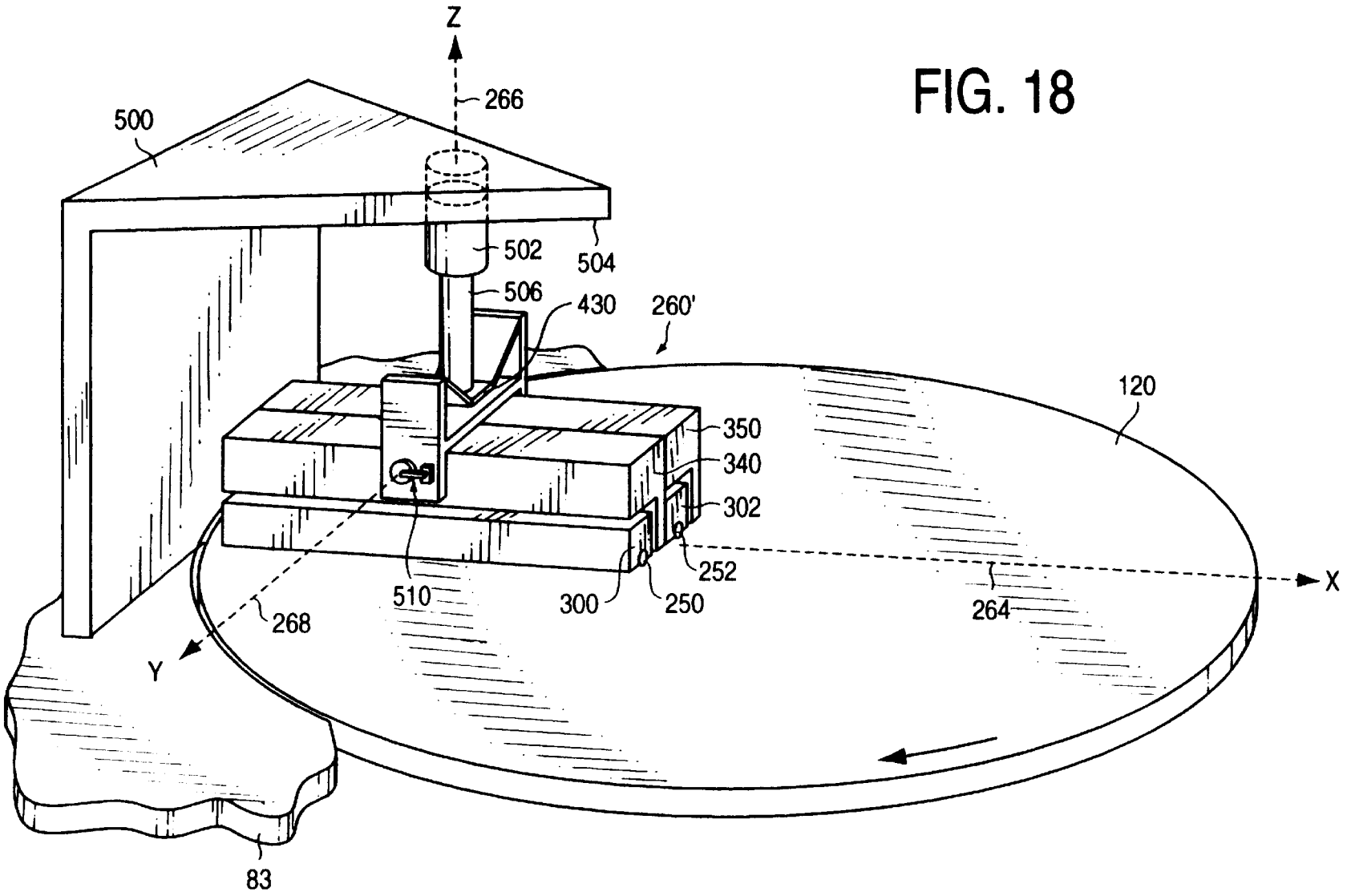
FIG. 18 is a schematic perspective view of another embodiment of a conditioner apparatus with a piezoelectric actuator in accordance with the present invention.

Gimbal mechanism 460 also includes an arm 470 which is connected to an air cylinder mounted on the table top (not shown FIG. 13) in a manner similar to that shown in FIG. 13 or FIG. 18. Arm 470 extends horizontally over the polishing pad and supports a "near" pivot joint 472 and a "far" pivot joint 474. Far joint 474 is farther away the from frame 462 than near joint 472.

Two bars, a short bar 480 and a long bar 485, connect frame 462 to arm 470. Short bar 480 and long bar 485 extend laterally from arm 470 and hold the side of frame 462. In particular, short bar 480 is pivotally attached to near joint 472 of arm 470 and to frame 462 near the top of flange 466, whereas long bar 485 is pivotally attached to far joint 474 of arm 470 and to frame 462 near the bottom of flange 466. If the polishing pad pushes leading conditioner rod 250 upwardly, bars 480 and 485 force frame 462 to pivot about the x-axis (not shown in FIG. 17 because this axis is coming out of the page) and press trailing conditioner rod 252 downwardly against the polishing pad. Gimbal mechanism 460 creates abrasive contact along two parallel segments to ensure even pressure and uniform wear of the polishing pad.

Figure 19:
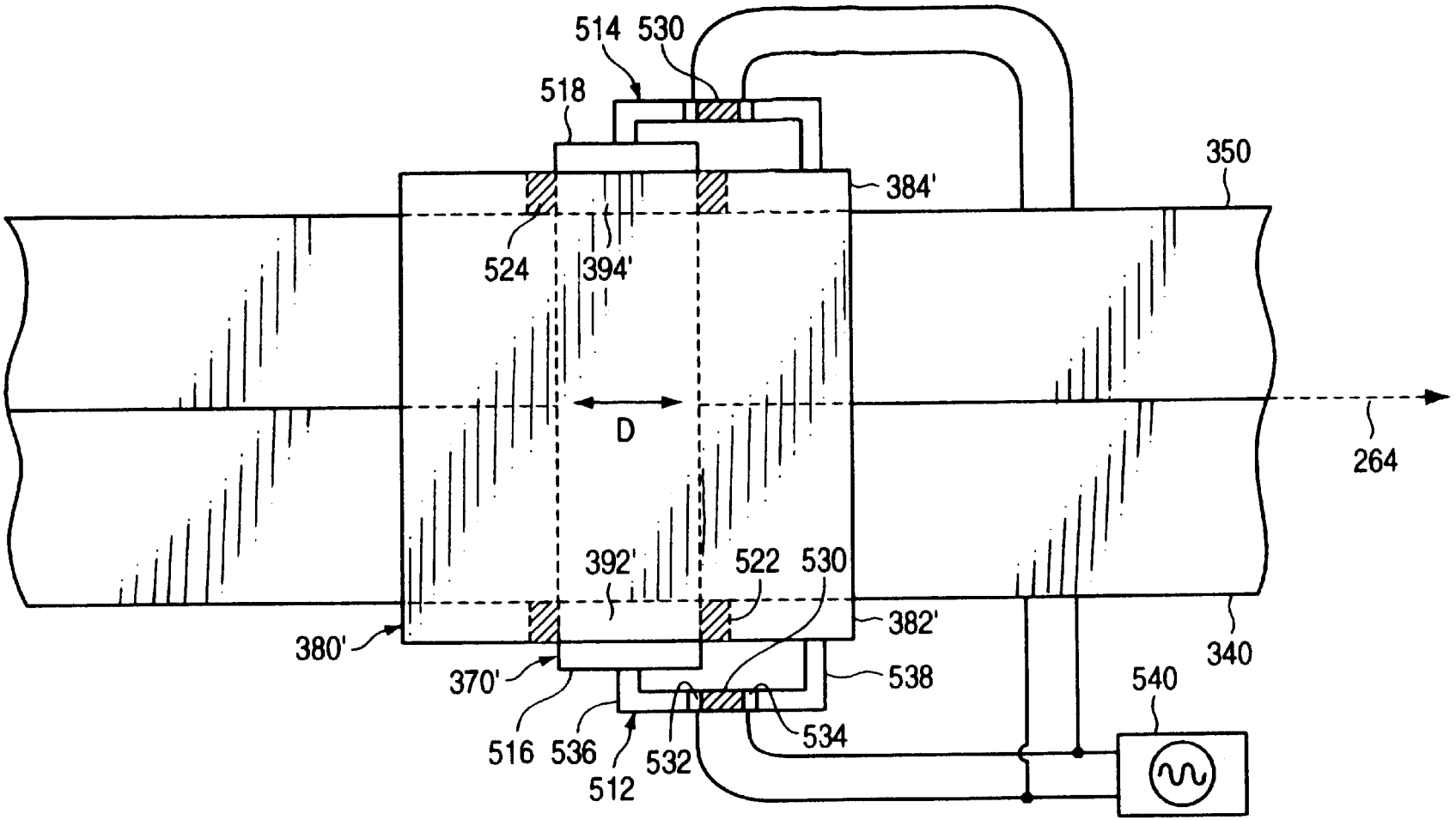
FIG. 19 is a schematic top view of a piezoelectric actuator of the linear conditioner apparatus of FIG. 18.

In an alternate embodiment, shown in FIGS. 18 and 19, carriage 260' is suspended from a housing 500 mounted on table top 83. A pneumatic cylinder 502 is suspended from a surface 504 of housing 500. A vertically-movable rod 506 extends from pneumatic cylinder 502 to connect housing 500 to flex tie 430 of carriage 260'. Pneumatic cylinder 502 can force rod 506 and carriage 260' downwardly to press conditioner rods 250 and 252 against polishing pad 120. Elements of the embodiment of FIGS. 18 and 19 which are substantially similar, but not identical to elements of the embodiment of FIGS. 13–17 are marked with a primed sign.

Conditioner rods 250 and 252 can be moved along x-axis 264 by a piezoelectric actuator assembly 510. As shown in more detail in FIG. 19, piezoelectric actuator assembly 510 may comprise two piezoelectric actuators 512 and 514. Piezoelectric actuator 512 may connect leading end 516 of pin 370' to leading flange 382' of flexure hub 380'. Piezoelectric actuator 514 may connect trailing end 518 of pin 370' to trailing flange 384' of flexure hub 380'. Two annular elastic members 522 and 524 hold pin 370' in apertures 392' and 394'.

The piezoelectric actuators force the pin 370' to move in the direction indicated by arrow "D" relative to the flexure hub 380'. When pin 370' moves, it moves trailing and leading brackets 340 and 350, mounting apparatus 300 and 302, and the attached conditioner rods 250 and 252, along x-axis 264. Elastic members 522 and 524 are compressible so that they hold pin 370' but do not impede its horizontal motion.

Each piezoelectric actuator includes a piezoelectric member 530 sandwiched between two electrodes 532 and 534. The piezoelectric member 530 is connected to the pin and the flexure hub flange by two arms 536 and 538. To drive the piezoelectric actuator assembly 510, a voltage source 540 applies a voltage to both piezoelectric actuators 530 during the conditioning process. Preferably, the voltage is an AC voltage with a frequency of about one to one-thousand Hz. The applied voltage causes piezoelectric actuators 530 to expand and contract, and oscillates pin 370' and conditioner rods 250 and 252 along the x-axis. With each oscillation, the conditioner rods travel less than a millimeter backward and forward along the x-axis. Preferably, the conditioner rods travel more than fifty microns, and most preferably about one-hundred microns. By vibrating conditioner rods 250 and 252 about one-hundred microns in a direction perpendicular to the rotation of polishing pad 120, the conditioner rods will cut overlapping grooves across the entire surface of the polishing pad. A single voltage source 540 applies the same voltage across both piezoelectric actuators so that leading end 516 and trailing end 518 of pin 370' undergo identical displacement to prevent pin 370' from rotating about z-axis 266.

Many possible alternate configurations of a piezoelectric actuator will occur to those of skill in the art. For example, the actuator may be placed between a conditioner rod and a rod holder, or between shaft 466 and flex tie 430. The present invention comtemplates any piezoelectric configuration to vibrate a linear conditioner substantially along its longitudinal axis.

In summary, the conditioner apparatus of the present invention uses one or more linear conditioners. The linear conditioners extend from the edge of the polishing pad almost to the center of the pad. In a preferred embodiment, the conditioner apparatus uses two conditioner rods located on either side of a radial segment. The rods pivot so that if one rod rises, the other rod is forced downwardly. In addition, the rods can pivot independently about a lateral axis, but they cannot pivot around the vertical axis. The linear conditioners may be actuated by a piezoelectric device.

The present invention has been described in terms of a preferred embodiment. The invention, however, is not limited to the embodiment depicted and described. Rather, the scope of the invention is defined by the appended claims.

What is claimed is:

1. A conditioner apparatus for a chemical mechanical polishing system comprising:

a first conditioner member having a first abrasive surface; and a second conditioner member having a second abrasive surface;

said first and second abrasive surfaces arranged to contact a polishing pad in two substantially parallel linear segments extending from an edge of said polishing pad toward a center of said polishing pad.

2. A conditioner apparatus for a chemical mechanical polishing system, comprising:

a first conditioner member having a first abrasive surface;

a second conditioner member having a second abrasive surface, said first and second abrasive surfaces arranged to contact a polishing pad in two substantially parallel linear segments extending from an edge of said polishing pad toward a center of said polishing pad; and a gimbal mechanism connected to said first and second conditioner members, said gimbal mechanism including means for preventing said conditioner members from pivoting about a first axis substantially parallel to an axis of rotation of said polishing pad, means for permitting said conditioner members to pivot together about a second axis which is parallel to a longitudinal axis of said conditioner members and located in a plane where said conditioner members contact said polishing pad, and means for permitting said conditioner members to pivot independently about a third axis which is perpendicular to the first and second axes.

3. The apparatus of claim 2 wherein said gimbal mechanism includes a pin which extends along said third axis and said conditioner members each include a passage, said pin extending through said passages.

4. The apparatus of claim 2 wherein said gimbal mechanism includes a flexure joint.

5. The apparatus of claim 2 further comprising a load mechanism to press said conditioner members against said polishing pad.

6. The apparatus of claim 1 further comprising a means for radially oscillating said conditioner members relative to said polishing pad.

7. The apparatus of claim 6 wherein said oscillating means comprises an arm connected to a motor.

8. The apparatus of claim 6 wherein said oscillating means comprises a piezoelectric actuator.

9. The apparatus of claim 1, wherein said linear segments are located on different sides of a radius of the polishing pad.

10. A method of conditioning a polishing pad comprising:

bringing a first conditioning member having an abrasive outer surface into contact with a polishing pad along a first linear segment which extends from an edge of said polishing pad to near a center of said polishing pad; and bringing a second conditioner member having an abrasive outer surface into contact with said polishing pad, said second conditioner member contacting said polishing pad in a second linear segment which is substantially parallel to said first segment and which extends from the edge of said polishing pad to near the center of said polishing pad.

11. The method of claim 10, further comprising radially oscillating said first and second conditioning members relative to said polishing pad.

12. The method of claim 11 wherein said conditioner members oscillate less than a millimeter.

13. The method of claim 10 further comprising rotating said polishing pad relative to said first and second conditioning members.

14. A method of conditioning a polishing pad comprising:

bringing a conditioning member having an abrasive surface into contact with a polishing pad along a linear segment extending substantially from an edge of the polishing pad toward a center of the polishing pad such that a first angle is formed between the linear segment and a radius of the polishing pad; and pivoting the conditioning member until it crosses the radius and a second angle is formed between the linear segment and the radius.

15. The method of claim 14, wherein the first angle is approximately equal to the second angle.

16. The method of claim 15, wherein the first angle is about 5°.

17. The method of claim 14, wherein the conditioning member is pivoted about a point on the radius.

18. A conditioner apparatus for a chemical mechanical polishing system, comprising:

a support arm;

a hub pivotally connected to the support arm so as to pivot about a first axis which is parallel to the surface of a polishing pad;

a first conditioner member pivotally connected to the hub so as to pivot about a second axis which is perpendicular to the first axis, the first conditioning member having a first abrasive surface arranged to contact a polishing pad in a first substantially linear segment generally parallel to the first axis; and a second conditioner member pivotally connected to the hub so as to pivot about the second axis independently of the first conditioner member, the second conditioning member having a second abrasive surface arranged to contact the polishing pad in a second linear segment substantially parallel to the first linear segment.

* * * * *